US007661898B2

(12) United States Patent
Ng et al.

(10) Patent No.: US 7,661,898 B2
(45) Date of Patent: Feb. 16, 2010

(54) SOFT CLOSE RING BINDER MECHANISM WITH REINFORCED TRAVEL BAR

(75) Inventors: Wing Yiu Ng, Hong Kong (CN); Hung Yu Cheng, Hong Kong (CN)

(73) Assignee: World Wide Stationery Manufacturing Company, Limited, Kwai Chung, New Territory (HK)

( * ) Notice: Subject to any disclaimer, the term of this patent is extended or adjusted under 35 U.S.C. 154(b) by 699 days.

(21) Appl. No.: 10/905,031

(22) Filed: Dec. 10, 2004

(65) Prior Publication Data

US 2005/0214064 A1 Sep. 29, 2005

Related U.S. Application Data

(63) Continuation-in-part of application No. 10/870,165, filed on Jun. 17, 2004.

(60) Provisional application No. 60/553,155, filed on Mar. 15, 2004.

(51) Int. Cl.
*B42F 13/02* (2006.01)

(52) U.S. Cl. ..... 402/20; 402/26; 402/37

(58) Field of Classification Search ..... 402/19, 402/20, 26, 31, 35, 36, 37, 38, 39, 41, 42, 402/70, 73, 80 R, 502

See application file for complete search history.

(56) References Cited

U.S. PATENT DOCUMENTS 566,717 A 8/1896 Krah
651,254 A 6/1900 Krah
683,019 A 9/1901 Buchanan
790,382 A 5/1905 McBride (Continued)

FOREIGN PATENT DOCUMENTS

DE 10119121 A1 10/2001

(Continued)

OTHER PUBLICATIONS

Kokuyo Lock Ring Mechanism with description, two instruction sheets, and nine photographs, undated but admited as prior art, 12 pgs.

(Continued)

*Primary Examiner*—Dana Ross
*Assistant Examiner*—Jamila Williams
(74) *Attorney, Agent, or Firm*—Senniger Powers LLP

(57) ABSTRACT

A ring binder mechanism includes a housing that supports two hinge plates for loose pivoting motion, moving the ring members apart or together. The mechanism also includes an actuating lever pivotally mounted on the housing. The lever moves a travel bar and its locking elements for controllably pivoting the hinge plates and the ring members mounted thereon between closed and open positions. In particular, the locking elements cam the hinge plates to softly close the ring members. When the ring members are apart, the locking elements register with openings in at least one of the hinge plates. When the ring members are together, the locking elements are substantially out of registration with the openings, blocking the hinge plates from pivoting to separate the ring members. The travel bar is formed with reinforcing structure to resist deforming the travel bar upon repeated operation.

27 Claims, 25 Drawing Sheets

U.S. PATENT DOCUMENTS 854,074 A 5/1907 Bryant
857,377 A 6/1907 Baker
974,831 A 11/1910 Scherzinger
1,011,391 A 12/1911 Sturgis
1,163,179 A 12/1915 Schade
1,168,260 A 1/1916 Albrecht
1,398,034 A 11/1921 Mero
1,398,388 A 11/1921 Murphy
1,733,548 A 10/1929 Martin
1,733,894 A 10/1929 Martin
1,787,957 A 1/1931 Schade
1,822,669 A 9/1931 Schade
1,857,291 A 5/1932 Trussell
1,953,981 A 4/1934 Trussell
1,991,362 A 2/1935 Krag
1,996,463 A 4/1935 Dawson
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,089,211 A 8/1937 Krag
2,096,944 A 10/1937 Unger
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 Louis
2,251,878 A * 8/1941 Hanna et al. ..... 402/26
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson
2,543,866 A 3/1951 Panfil
2,552,076 A 5/1951 Wedge
2,612,169 A 9/1952 Segal
2,789,561 A 4/1957 Bonn
2,865,377 A 12/1958 Schroer
2,871,711 A 2/1959 Stark
2,891,553 A 6/1959 Acton
2,894,513 A 7/1959 Gempe
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider
3,205,894 A 9/1965 Rankin
3,205,895 A 9/1965 Johnson
3,255,759 A 6/1966 Dennis
3,348,550 A 10/1967 Wolf
3,718,402 A 2/1973 Schade
3,748,051 A 7/1973 Frank
3,884,586 A 5/1975 Michaelis
3,954,343 A 5/1976 Thomsen
3,993,374 A 11/1976 Schudy et al.
4,127,340 A 11/1978 Almgren
4,130,368 A 12/1978 Jacoby et al.
4,296,529 A * 10/1981 Brown ..... 24/30.5 P
4,352,582 A 10/1982 Eliasson
4,486,112 A 12/1984 Cummins
4,522,526 A 6/1985 Lozfau
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence
4,919,557 A 4/1990 Podosek
5,067,840 A 11/1991 Cooper
5,116,157 A 5/1992 Gillum
5,135,323 A 8/1992 Pinheiro
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,507,658 A * 4/1996 Ho ..... 439/159
5,524,997 A * 6/1996 von Rohrscheidt ..... 402/19
5,577,852 A 11/1996 To
5,651,628 A 7/1997 Bankes
5,660,490 A * 8/1997 Warrington ..... 402/36
5,692,847 A 12/1997 Zane
5,692,848 A 12/1997 Wada
5,718,529 A 2/1998 Chan
5,782,569 A 7/1998 Mullin et al.
5,788,392 A 8/1998 Cheung
5,803,228 A * 9/1998 Lucas ..... 194/350
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A 4/1999 Wu
5,924,811 A 7/1999 To
5,957,611 A 9/1999 Whaley
5,975,785 A 11/1999 Chan
6,036,394 A 3/2000 Cheng
6,142,697 A 11/2000 Williams
6,146,042 A * 11/2000 To et al. ..... 402/26
6,155,737 A 12/2000 Whaley
6,203,229 B1 3/2001 Coerver
6,206,601 B1 * 3/2001 Ko ..... 402/38
6,217,247 B1 4/2001 Ng
6,270,279 B1 8/2001 Whaley
6,276,862 B1 8/2001 Snyder et al.
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 6/2004 Cheng
6,758,621 B2 7/2004 To
6,821,045 B2 * 11/2004 Whaley ..... 402/62
6,840,695 B2 1/2005 Horn
6,916,134 B2 7/2005 Wong
7,296,946 B2 * 11/2007 Cheng et al. ..... 402/19
2003/0044221 A1 3/2003 To
2003/0103797 A1 6/2003 Cheng
2003/0103798 A1 6/2003 Cheng et al.
2003/0123923 A1 7/2003 Koike et al.
2005/0013654 A1 1/2005 Cheng et al.
2005/0201817 A1 9/2005 Cheng
2005/0201818 A1 9/2005 Cheng

| | | | | |
|---|---|---|---|---|
| 2005/0201819 | A1 | 9/2005 | Cheng | |
| 2005/0201820 | A1* | 9/2005 | Ng et al. | 402/73 |
| 2005/0207826 | A1 | 9/2005 | Cheng | |
| 2005/0232689 | A1 | 10/2005 | Cheng | |
| 2006/0008318 | A1* | 1/2006 | Ng | 402/19 |
| 2006/0056906 | A1 | 3/2006 | Horn | |
| 2006/0088365 | A1 | 4/2006 | Whaley | |
| 2006/0147253 | A1 | 7/2006 | Cheng | |
| 2006/0147254 | A1 | 7/2006 | Cheng | |
| 2006/0147255 | A1 | 7/2006 | Cheng | |
| 2006/0153628 | A1 | 7/2006 | Tanaka | |
| 2006/0153629 | A1 | 7/2006 | Cheng | |
| 2006/0216107 | A1 | 9/2006 | Lin | |
| 2006/0228164 | A1 | 10/2006 | Horn | |
| 2006/0251467 | A1 | 11/2006 | Cheng | |
| 2006/0251468 | A1 | 11/2006 | Cheng | |
| 2007/0086836 | A1 | 4/2007 | Cheng | |

FOREIGN PATENT DOCUMENTS

| | | | |
|---|---|---|---|
| EP | 1316438 | A1 | 6/2003 |
| EP | 1323545 | A2 | 7/2003 |
| EP | 1431065 | A2 | 6/2004 |
| FR | 1 336 765 | | 7/1962 |
| FR | 1336765 | | 9/1963 |
| FR | 1 346 864 | A | 12/1963 |
| FR | 1346864 | | 12/1963 |
| FR | 2221924 | | 10/1974 |
| FR | 2 238 332 | A | 2/1975 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 59-79379 | | 5/1984 |
| JP | 61-18880 | | 2/1986 |
| JP | 01299095 | A | 12/1989 |
| JP | 2034289 | U | 3/1990 |
| JP | 4-120085 | | 10/1992 |
| JP | 2004098417 | A | 4/2004 |
| WO | 0119620 | A1 | 3/2001 |
| WO | WO 01/19620 | A1 | 3/2001 |
| WO | 0181099 | A1 | 11/2001 |

OTHER PUBLICATIONS

Office Action dated Jan. 3, 2008 from related U.S. Appl. No. 10/870,165, 14 pages.

Office Action dated Apr. 20, 2007 from related U.S. Appl. No. 10/323,052 now issued as U.S. Patent No. 7,296,946, 12 pages—(see p. 5).

Office Action dated May 30, 2008 from related U.S. Appl. No. 11/080,710, 10 pgs.

Advisory Action dated Oct. 9, 2008 from related U.S. Appl. No. 10/870,801, 3 pgs.

WordReference.com English Dictionary definition for "translation"; Oct. 2, 2008; http://www.wordreference.com/definition/translation; 1 pg.

Office action dated Jan. 30, 2009 from related U.S. Appl. No. 11/080,710, 10 pgs.

Office Action dated Mar. 23, 2009 from related U.S. Appl. No. 10/870,165, 13 pgs.

Appeal Brief filed Dec. 9, 2008 in response to Office action issued Aug. 11, 2008 in related U.S. Appl. No. 10/870,165, 40 pgs.

* cited by examiner

H'
465'
466'
W'
540b'
542b'
533b'
540b'
533a'
540a'
542a'
H'
540a'
466'

466'
465'
526b'
526a'
466'

466'
465'
526b'
526a'
466'

W'
526b'
526'
528'
522'
526'

SOFT CLOSE RING BINDER MECHANISM WITH REINFORCED TRAVEL BAR

CROSS-REFERENCE TO RELATED APPLICATION

This application is a Continuation-In-Part of U.S. patent application Ser. No. 10/870,165, filed Jun. 17, 2004, which claims the benefit of U.S. Provisional Application No. 60/553,155, filed Mar. 15, 2004, the entire texts of which are hereby incorporated by reference.

BACKGROUND OF THE INVENTION

This invention relates to a ring binder mechanism for retaining loose-leaf pages, and in particular it relates to an improved mechanism for reducing snapping motion of ring members as they close and for securely locking closed ring members together.

As is known in the art, a typical ring binder mechanism retains loose-leaf pages, such as hole-punched papers, in a file or notebook. It generally features multiple rings each including two half ring members capable of selectively opening to add or remove papers, or selectively closing to retain papers and allow them to move along the rings. The ring members mount on two adjacent hinge plates that join together about a pivot axis for pivoting movement within an elongated housing. The housing loosely holds the hinge plates so they may pivot relative to the housing. The undeformed housing is slightly narrower than the joined hinge plates when the hinge plates are in a coplanar position (180°). So as the hinge plates pivot through this position, they deform the resilient housing and cause a spring force in the housing, urging the hinge plates to pivot away from the coplanar position either opening or closing the ring members. Thus, when the ring members are closed, this spring force resists hinge plate movement and clamps the ring members together. Similarly, when the ring members are open, the spring force holds them apart. An operator may typically overcome this force by manually pulling the ring members apart or pushing them together. In addition, in some mechanisms the operator may move a lever located at one or both ends of the mechanism for moving the hinge plates through the coplanar position to open or close the ring members (in addition to manually pulling the ring members apart or pushing them together).

One drawback to these typical ring binder mechanisms is that when the ring members close, the housing's spring force snaps them together rapidly and with a force that might cause fingers to be pinched between the ring members. The substantial spring force required to keep the ring members closed also makes pivoting the hinge plates through the coplanar position difficult, making it hard to both open and close the ring members. Another drawback is that when the ring members are closed, they do not positively lock together. So if the mechanism accidentally drops, the ring members may unintentionally open. Still another drawback is that over time the housing may begin to permanently deform, reducing its ability to uniformly clamp the ring members together and possibly causing uneven movements or gaps between closed ring members.

To address these concerns, some ring binder mechanisms include a control slide directly attached to the lever. These control slides have inclined cam surfaces that project through openings in the hinge plates for rigidly controlling the hinge plates' pivoting motion both when opening and closing the ring members. Examples of these types of mechanisms are shown in U.S. Pat. Nos. 4,566,817, 4,571,108, and 6,276,862 and in U.K. Pat. No. 2,292,343. Some of these cam surfaces include a stop for blocking the hinge plates' pivoting motion when the ring members are closed, locking the closed ring members together.

But these mechanisms still have several drawbacks, including that when the ring members close, the housing's spring force may still snap them together. The spring force may also still make both opening and closing the ring members difficult. Furthermore, the control slides in these mechanisms, specifically the inclined cam surfaces and stops, are complexly shaped and can be difficult and time consuming to fabricate. Also, since the control slides directly bias the hinge plates, they are usually relatively wide and may need to be constructed of a large gauge metal to withstand forces associated with repeated use (i.e., repeatedly biasing the hinge plates to pivot). Therefore, the openings in the hinge plates receiving these control slides may also be relatively wide, possibly weakening the hinge plates so that they too must be made of a large gauge metal. These uses of large gauge metal may make mass production more costly. In addition, repeated engagement of the control slides with the hinge plates during operation may deform the control structure slides so that the slides cannot fully pivot the hinge plates to open or close the ring members. The deformed slides may additionally be unable to fully close ring members or lock the closed ring members together, leaving gaps between the closed ring members. Each of these problems can leave the mechanism inoperable.

Other ring binder mechanisms attempt to address the issues of avoiding snapping motion of the ring members and positively locking the ring members in the closed position. For instance, some mechanisms arrange the hinge plates so that they never pass through the coplanar position in their pivoting motion. As a result of avoiding the coplanar position of the hinge plates, the ring members do not violently snap together upon closing. However, a closing force applied to the ring members is relatively weak so that it is necessary to provide a separate locking device to keep the ring members closed. One example of this type of ring mechanism is shown in U.S. Pat. No. 5,660,490. Still another solution is to arrange the hinge plates and housing so that the hinge plates are only weakly biased by the housing. This may be accomplished by adding a separate wire form spring to the underside of the hinge plates to provide a bias for pivoting the hinge plates to a position in which the ring members are open. An example of this ring binder mechanism construction is shown in U.S. Pat. Appl. Publ. No. 2003/0123923 to Koike, et al. In these types of mechanisms, the ends of the ring members are formed with hooks that are engaged upon closing to hold the ring members in the closed position. It requires some dexterity to manipulate the ring members to engage and disengage them. The manipulation becomes even more difficult if the ring members are filled with loose-leaf pages. Further, the hooks are more susceptible to forces that may unintentionally open the ring binder. Moreover, ring binder mechanisms having multiple ring members requiring simultaneous engagement or disengagement of hooks may make operation more awkward and difficult.

Consequently, there is a need for a ring binder mechanism that securely locks for retaining loose-leaf pages but has ring members that reliably open and close as pages accumulate and do not snap together when the ring members close. The present invention is directed to such a ring binder mechanism.

SUMMARY OF THE INVENTION

This invention relates to a ring binder mechanism for retaining loose-leaf pages. The mechanism generally comprises a housing, having longitudinal ends, and hinge plates with at least one opening therein supported by the housing for pivoting motion relative to the housing. Rings hold the loose-leaf pages. Each ring includes a first ring member and a second ring member. The first ring member is mounted on a first hinge plate and is moveable with the pivoting motion of the first hinge plate relative to the second ring member. In a closed position, the two ring members form a substantially continuous, closed loop for allowing loose-leaf pages retained by the rings to be moved along the rings from one ring member to the other. In an open position, the two ring members form a discontinuous, open loop for adding or removing loose-leaf pages from the rings. The mechanism also comprises a travel bar with two longitudinal edge margins movable in translation relative to the housing and the hinge plates, and a locking element moveable with the travel bar. The locking element engages at least one hinge plate and produces the pivoting motion of the hinge plates when the locking element moves from a position in registration with the opening in the hinge plates to a position substantially out of registration with the opening. The travel bar includes reinforcing structure constructed and arranged to resist bending about an axis extending lengthwise of the travel bar and to resist bending about an axis widthwise of the travel bar for rigidifying the travel bar.

In another aspect, a method of forming a reinforced travel bar of a ring binder mechanism generally comprises a step of forming at least one indentation in a sheet of material. The sheet is then cut along an axis to separate the indentation into two partial indentations. The sheet is bent at the partial indentation to form reinforcing structure for rigidifying the travel bar against axial bending.

Other features of the invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

Figure 1:
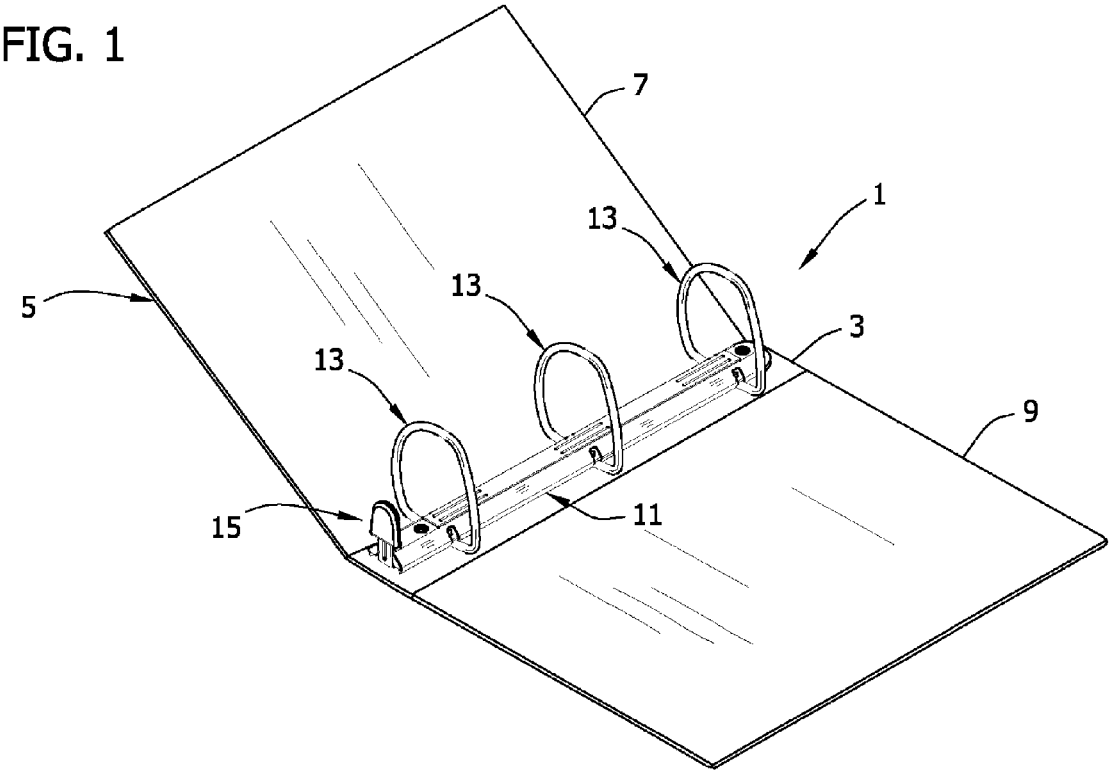
FIG. 1 is a perspective of a notebook incorporating a ring binder mechanism of the present invention according to a first embodiment.

Referring now to the drawings of the present invention, FIG. 1 shows a first embodiment of a ring binder mechanism of the present invention capable of retaining loose-leaf pages (not shown). The mechanism is generally designated by reference numeral 1 and is shown mounted on a spine 3 of a notebook (the notebook is designated generally by reference numeral 5) having a front cover 7 and a back cover 9 hingedly attached to the spine 3. The front and back covers 7, 9 move to selectively cover or expose retained pages. Ring binder mechanisms mounted on surfaces other than a notebook, however, do not depart from the scope of this invention. The mechanism 1 of this embodiment generally includes a housing 11, three rings (each generally indicated at 13), and a control structure (generally indicated at 15). As shown in FIGS. 2A-3B, the housing 11 supports both the rings 13 and the control structure 15 for either closing the mechanism 1 to retain pages on the rings 13 or opening it to load pages on the rings 13. As will be described hereinafter, the control structure 15 can either directly close and lock the mechanism 1 or it can allow wire form springs 17 attached to undersides of hinge plates 19, 21 to open the mechanism 1.

Figure 4:
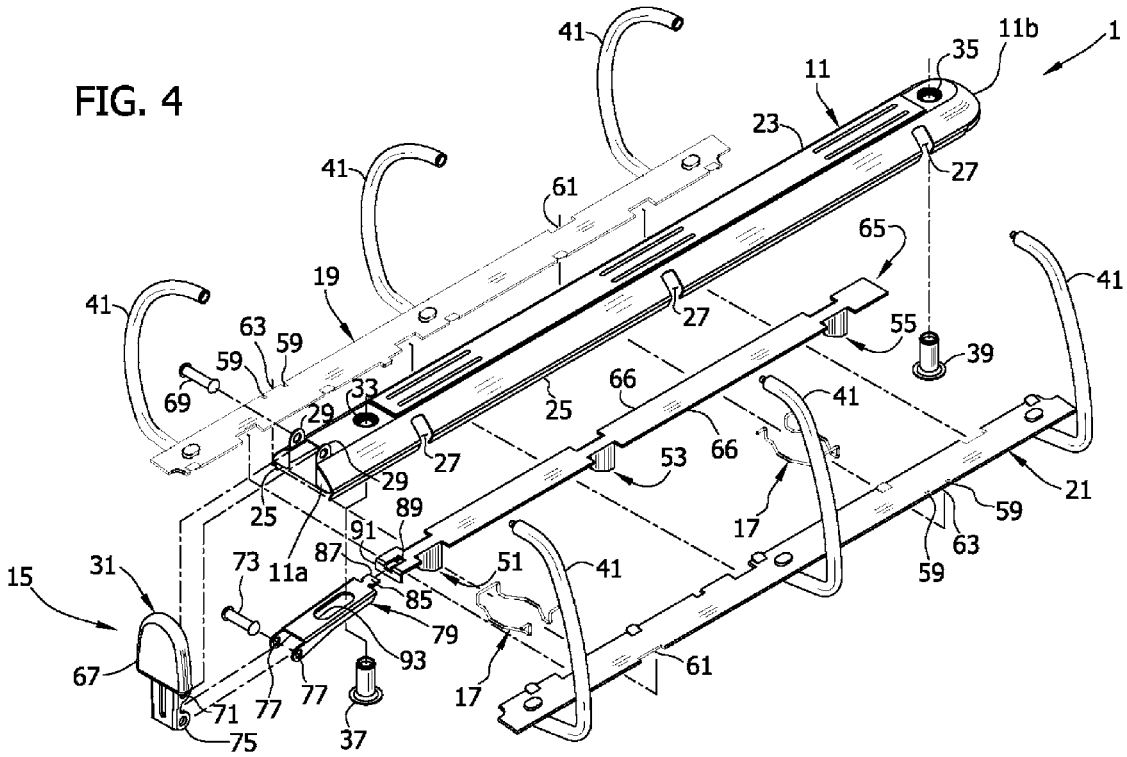
FIG. 4 is an exploded perspective of the mechanism.

Referring to FIG. 4, the housing 11 is elongate and has a symmetrical, roughly arch-shaped cross section with a raised plateau 23 at its center. The housing 11 is made of metal, but may be also made of other suitable material that is sufficiently rigid to provide a stable mount for other components of the mechanism 1 while being sufficiently resilient to function as a spring. The housing 11 has a longitudinal axis, two transversely opposite longitudinally extending edges, and two longitudinal ends 11*a*, 11*b*. A bent under rim 25 is formed along each longitudinal edge margin of the housing and together the two bent under rims 25 include six slots 27 (only three of which are visible) arranged in three transversely opposed pairs along the length of the housing 11 for receiving the rings 13 (see FIGS. 2A and 3A). At one housing end, two tabs 29 project upward for attaching an actuating lever 31 of the control structure. The opposite housing end does not have a lever, although it is understood that a mechanism with two levers or a mechanism with the lever attached between its ends does not depart from the scope of this invention. The raised plateau 23 of the housing has two openings 33, 35 for receiving and attaching mounting posts 37, 39 capable of securing the mechanism 1 to the notebook 5. Different shaped housings, including asymmetrical ones, and housings with different numbers of openings or slots do not depart from the scope of this invention.

The housing 11 loosely supports two hinge plates 19, 21 for pivoting motion to either close the rings 13 or open the rings 13. Each ring 13 includes two ring members 41 mounted on adjacent hinge plates 19, 21 and movable therewith between a closed position (see FIGS. 2A and 2B) and an open position (see FIGS. 3A and 3B). These ring members 41 are generally circular in cross section and are formed of suitable material such as steel. When they are in the closed position, each ring member 41 forms a substantially continuous, closed, "D"-shaped ring or loop for retaining loose-leaf pages and for allowing the pages to move along the rings 13 from one ring member 41 to the other. And when the ring members 41 are in the open position, each forms a discontinuous, open loop suitable for adding or removing pages. Although in the illustrated embodiment both ring members 41 can move, a mechanism having one movable ring member and one fixed does not depart from the scope of this invention. Additionally, a mechanism with more or less than three rings or with rings that form other shapes, such as a circular shape, when closed does not depart from the scope of this invention.

Figure 5:
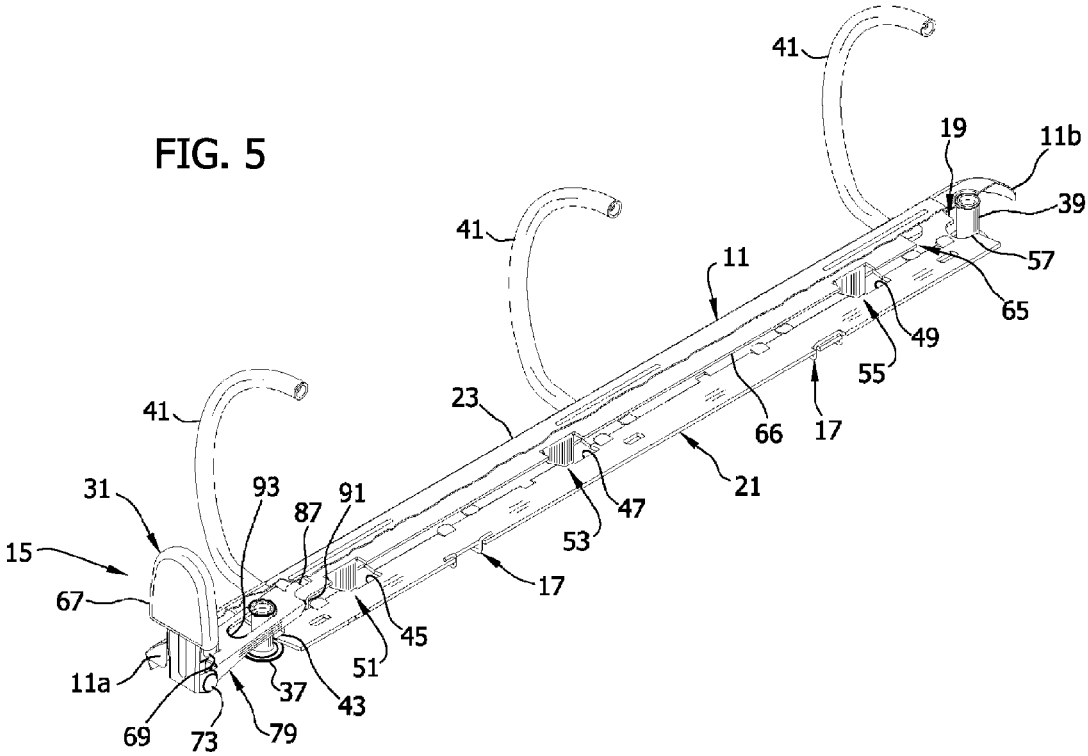
FIG. 5 is a perspective similar to FIG. 2A with a portion of a housing and ring members removed.

Referring now to FIGS. 4 and 5, the hinge plates 19, 21 are generally each a thin, elongate sheet having inner and outer longitudinal edge margins and two longitudinal ends. Each hinge plate 19, 21 includes five cutouts along its inner longitudinal edge margin so that when the hinge plates 19, 21 are interconnected, corresponding cutouts in each plate align to form five openings (FIG. 5). A first opening 43, located near the housing end having the lever 31, receives a first of the mounting posts 37 through the hinge plates 19, 21. Second, third, and fourth openings 45, 47, 49 receive first, second, and third locking elements 51, 53, 55 respectively, as will be discussed hereinafter. A fifth opening 57, located near the housing end not having the lever 31, receives a second of the mounting posts 39 through the hinge plates 19, 21. Each hinge plate 19, 21 also includes two notches 59 and one cutout 61, both located along the plate's outer longitudinal edge margin. The notches 59 are arranged relatively side-by-side and define a tab 63 located toward one longitudinal end of each hinge plate 19, 21. The cutout 61 is located toward an opposite longitudinal end. The tab 63 and cutout 61 are positioned in reverse order on the two hinge plates 19, 21 so that when the plates 19, 21 interconnect one plate's tab 63 is across from a second plate's cutout 61. This facilitates attaching the wire form springs 17 to the underside of the interconnected hinge plates 19, 21, as will be described more fully hereinafter.

The interconnected hinge plates 19, 21 attach to one another in parallel arrangement along their adjoining inner longitudinal edge margins, forming a central hinge having a pivot axis. The housing 11 receives the interconnected plates 19, 21 such that each plates's outer longitudinal edge margin loosely fits in the housing's corresponding bent under rim 25 (see FIGS. 2B and 3B). Accordingly, the hinge plates 19, 21 are retained on the housing 11 but the edge margins are free to move within the rims 25, allowing the hinge plates 19, 21 to freely pivot about their pivot axis relative to the housing. The pivot axis moves up (i.e., toward the housing's raised plateau 23) when the plates 19, 21 pivot to open the ring members 41, and it moves down (i.e., away from the housing's raised plateau 23) when the plates 19, 21 pivot to close the ring members 41.

The control structure 15 of this embodiment generally includes the actuating lever 31, a travel bar 65, and the three locking elements 51, 53, 55. The actuating lever 31 is formed from a suitable rigid material or combination of materials, such as metal or plastic. It includes an enlarged head 67 to facilitate gripping and applying force to the lever 31. A first hinge pin 69 received through upper openings 71 in the lever and through the housing's tabs 29, mounts the lever 31 on the housing 11 for pivoting relative to the housing 11. A second hinge pin 73 is received through lower openings 75 in the lever 31 and through openings 77 in an intermediate connector 79, transforming the lever's pivoting motion into substantially linear travel bar motion. Although the travel bar's motion is not perfectly linear, it is still considered to be translational motion for purposes of the present invention.

The intermediate connector 79 is generally an elongate beam with a flat web and two side flanges. It includes a first end that is generally wider than a second end. More specifically, at the narrower second end the intermediate connector 79 includes a projecting tab 85 with an enlarged end 87 that is received in a slot 89 in a first end of the travel bar 65. This end of the travel bar is bent down to form a shoulder 91 against one side of which the intermediate connector 79 can bear to push the travel bar 65. The enlarged end 87 of the projecting tab 85 is engageable with the other side of the shoulder 91 to pull the travel bar 65 toward the lever 31. The slot 89 in which the tab 85 is received is elongate in the lengthwise direction of the travel bar 65. Thus, the intermediate connector 79 is able to freely pivot up and down with respect to the travel bar 65. As a result, the connector 79 transmits a linear movement to the travel bar 65 from the pivoting lever 31. Moreover, the travel bar 65 is allowed to move up and down without hindrance from the intermediate connector 79. The intermediate connector 79 also includes an elongate opening 93 for receiving the first mounting post 37 through the connector and allowing the connector to move relative to the mounting post 37.

Figure 6:
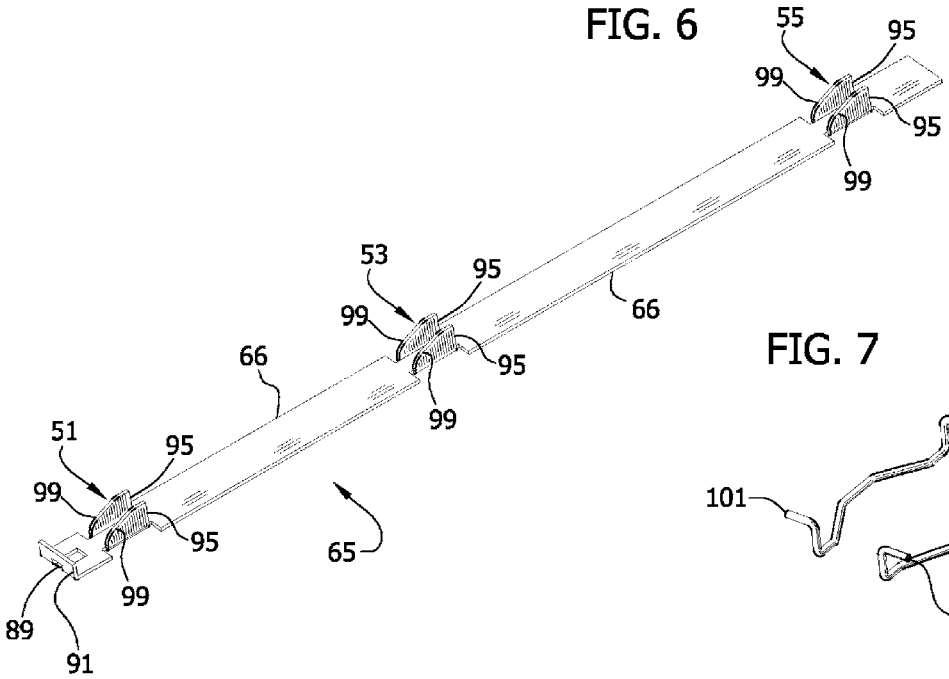
FIG. 6 is a bottom perspective of a travel bar of the first embodiment.

Now referring to FIGS. 4-6, the travel bar 65 receives the lever's pivoting motion and moves in translation generally lengthwise relative to both the housing 11 and the hinge plates 19, 21. The travel bar 65 is a relatively flat, elongate sheet made of metal or other sufficiently rigid material. It is disposed generally parallel to the longitudinal axis of the housing 11, under the housing's raised plateau 23 and above the hinge plates 19, 21. The travel bar 65 includes three integral locking elements 51, 53, 55 that move with the travel bar 65 in translation and, depending on the travel bar's position, can either (1) pivot the hinge plates 19, 21 for closing the ring members 41 and then block the hinge plates' pivoting motion for locking the ring members 41 closed or (2) allow the wire form springs 17 to pivot the hinge plates 19, 21 for opening the ring members 41 (i.e., the locking elements 51, 53, 55 can register with openings 45, 47, 49 in the hinge plates 19, 21, thereby allowing the wire form springs 17 to freely act against the hinge plates 19, 21 and pivot them, as will be discussed hereinafter).

As particularly shown in FIG. 6, in this embodiment the locking elements 51, 53, 55 each comprise two spaced apart flanges 95 formed as one piece with the travel bar 65 and folded downward 90° from a longitudinal edge margin (each edge margin is designated by reference numeral 66) of the bar. Accordingly, there are three flanges 95 on each side of the travel bar 65, and each flange's planar surface is substantially parallel to that of every other flange 95 and to a longitudinal axis of the travel bar 65. A lower edge portion of each flange is angled, forming a cam surface 99 for engaging the hinge plates 19, 21 and for causing them to pivot to close the ring members 41. The angle is such that once the ring members 41 close, the locking elements 51, 53, 55 slide into position for locking the ring members 41 together. In addition, the locking elements 51, 53, 55 are spaced along the length of the travel bar 65 to correspond with the second, third, and fourth openings 45, 47, 49 in the hinge plates 19, 21 when the ring members 41 are open. It will be understood that locking elements may be formed as a single piece with a travel bar, or as more than two pieces, and that control structures using more or fewer than three locking elements, or differently shaped locking elements do not depart from the scope of this invention.

Figure 7:
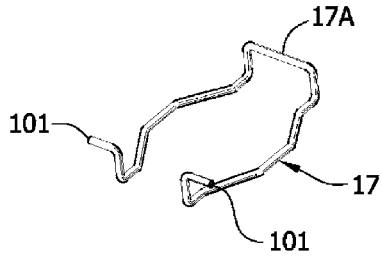
FIG. 7 is a perspective of a wire form spring of the first embodiment.
Figure 8:
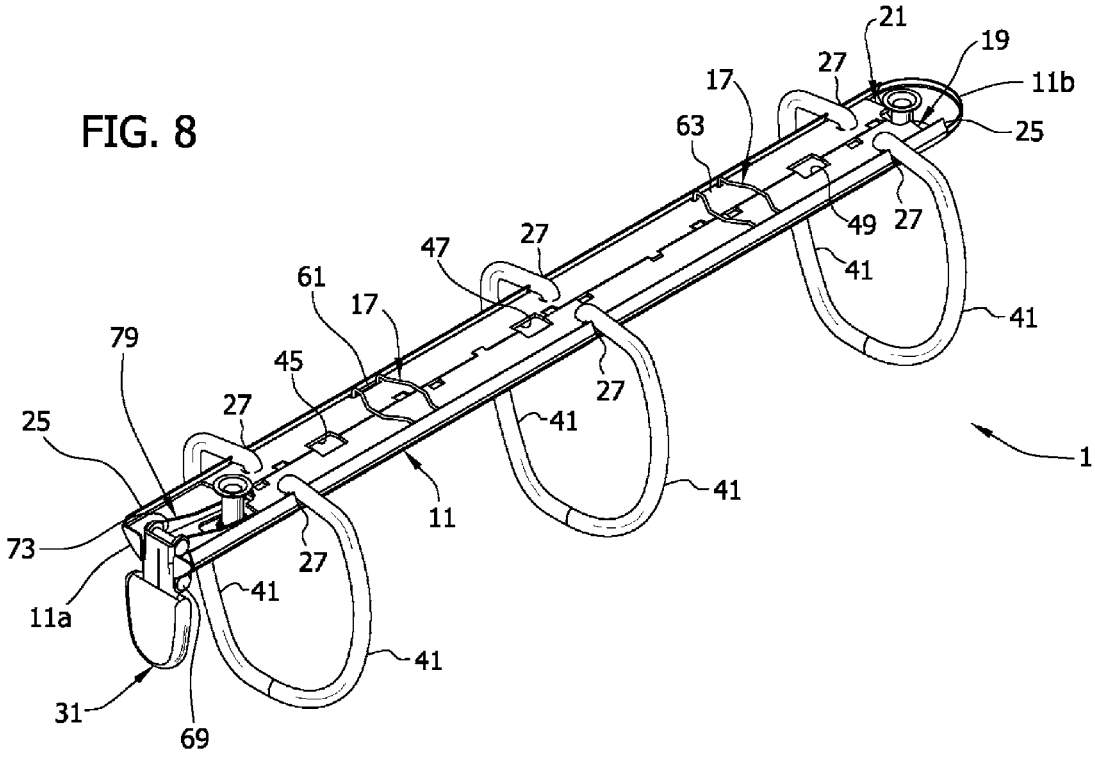
FIG. 8 is the perspective of FIG. 2A inverted.
Figure 9:
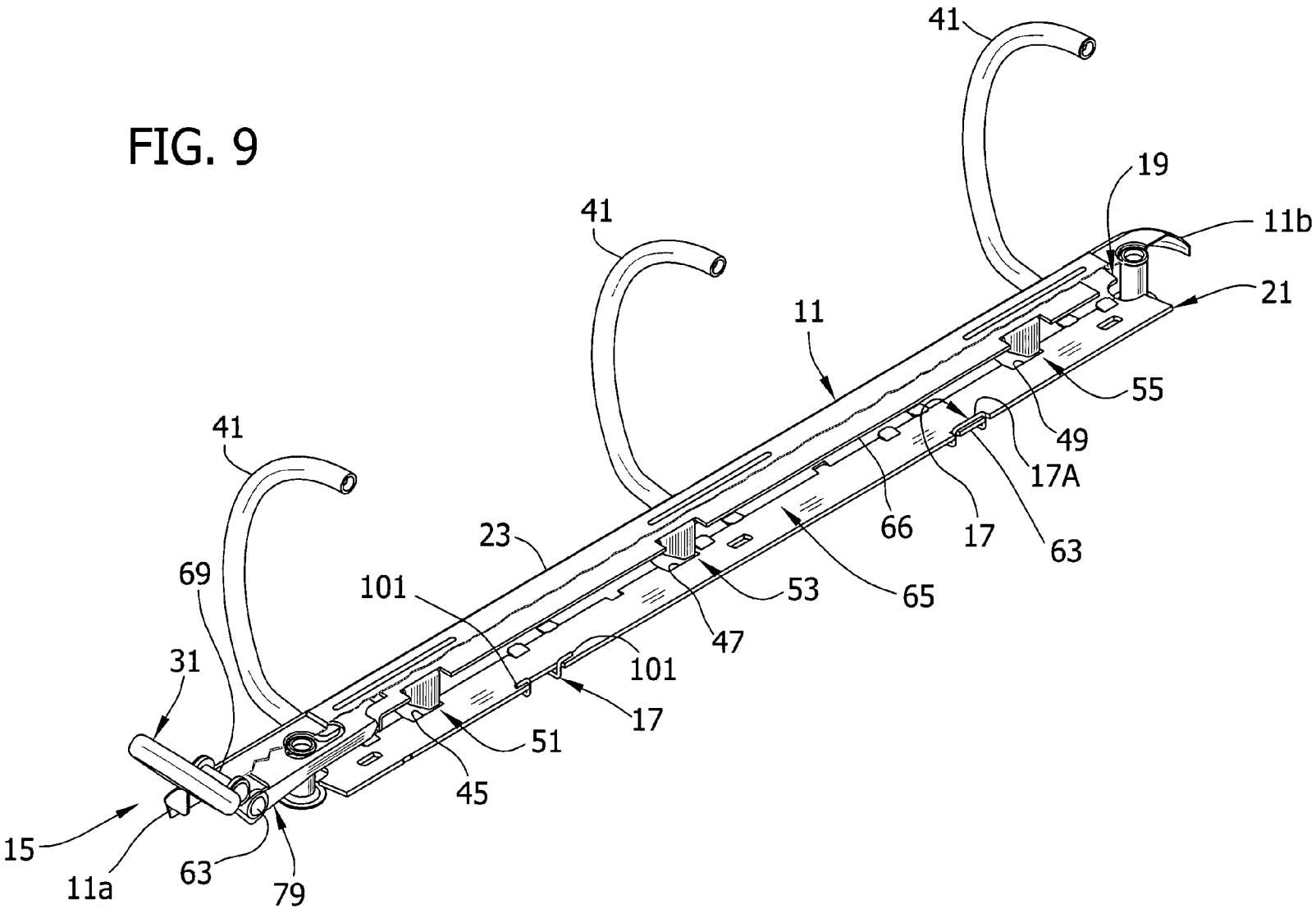
FIG. 9 is a perspective similar to FIG. 5 with the mechanism at an intermediate, transitional position between the open position and the closed and locked position.
Figure 10:
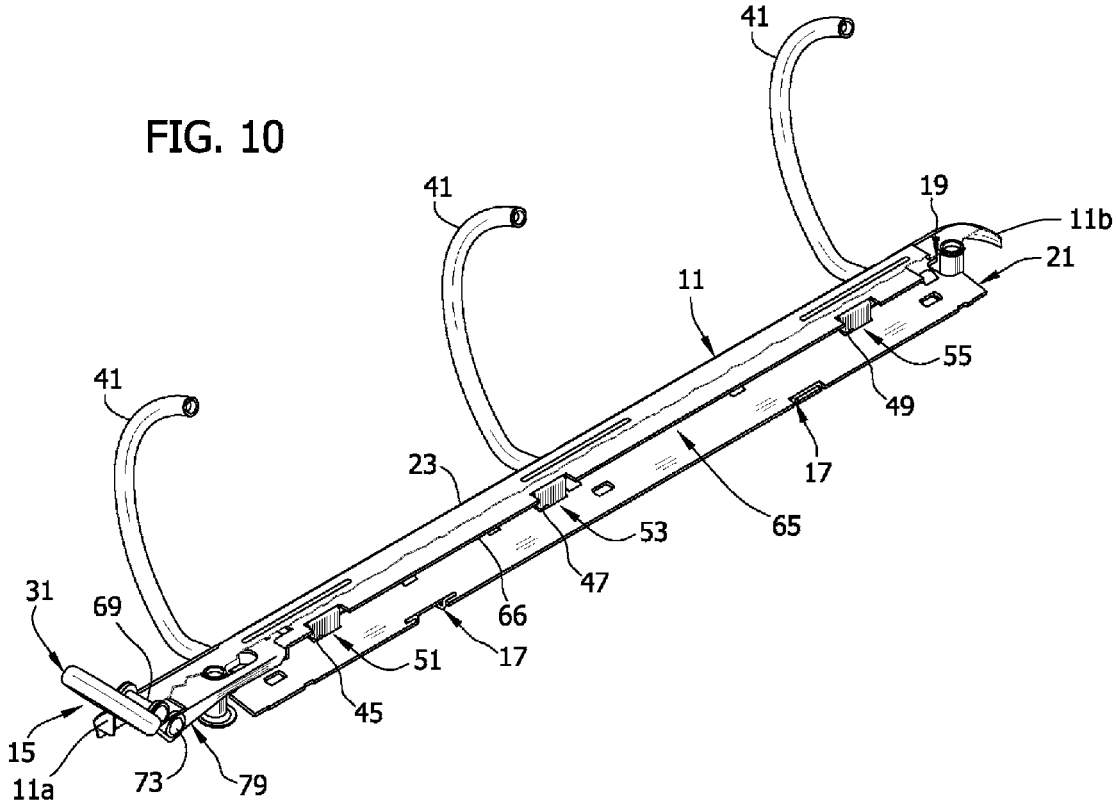
FIG. 10 is a perspective similar to FIG. 5 with the mechanism at the open position.
Figure 11:
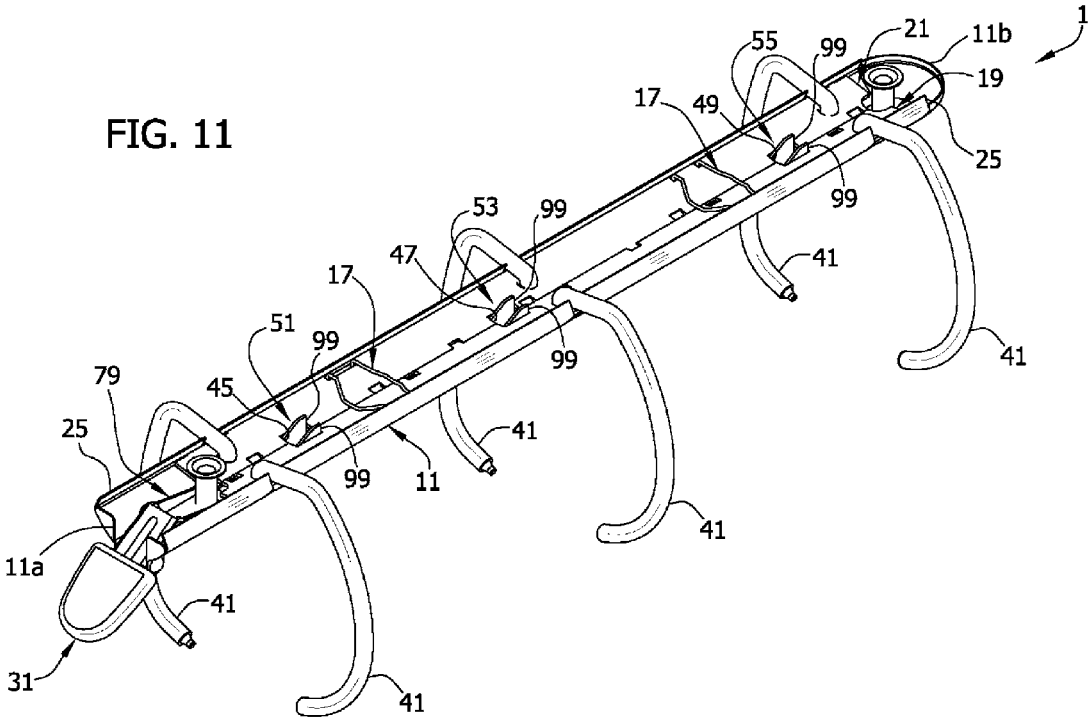
FIG. 11 is the perspective of FIG. 3A inverted.

As shown in FIGS. 7-9, a wire form spring 17 of this embodiment is a generally round wire formed roughly into an elongate octagon with an open end and a closed end 17A (the open end forming one of the sides of the octagon). The closed end 17A is bent upward 90° so that it fits into the notches 59 and over the tab 63 of one of the interconnected hinge plates 19, 21. The free end of the tab 63 is received behind the rim 25 of the housing so that the closed end 17A of the spring is held on the tab 63. The open end of each spring has two wire tips 101 that are each bent twice into a generally hook shape. A first bend is 90° upward and a second bend is 90° outward. These tips 101 releasably fit into the cutout 61 of the second interconnected hinge plate 19, 21 so that a body of the wire form spring 17 is positioned substantially beneath the interconnected plates 19, 21. As attached, the wire form springs 17 are relaxed when the hinge plates 19, 21 are oriented so that the ring members 41 are open. The body of the wire form spring 17 is bowed slightly upward (i.e., toward the interconnected plates 19, 21 (see FIG. 3B)) so that exterior surfaces of the interconnected hinge plates 19, 21 form an angle A that is less than 180° (i.e., the hinge plates' pivot axis is above a coplanar position of the hinge plates 19, 21). When the locking elements 51, 53, 55 move the hinge plates 19, 21 down and through the coplanar position for closing the ring members 41 (see FIG. 2B), each bowed wire form spring 17 flattens and becomes stressed. Conversely, when the locking elements 51, 53, 55 move into registration with respective openings 45, 47, 49 in the hinge plates 19, 21, the stressed wire form springs 17 automatically act on the hinge plates 19, 21 and pivot them up and through the coplanar position, opening the ring members 41. It is understood that while the illustrated mechanism 1 includes two wire form springs 17, mechanisms having fewer than two or more than two wire form springs do not depart from the scope of this invention.

Now referring to FIGS. 2A-3B, 5, and 8-11, the control structure 15 is capable of selectively controlling the mechanism's movement between a closed and locked position and an open position. At the closed and locked position (FIGS. 2A, 2B, 5 and 8), the ring members 41 are together and cannot be pulled apart. In this position the hinge plates 19, 21 are oriented so that their pivot axis is slightly below the coplanar position and the angle A between their exterior surfaces 103 is at its greatest. Additionally, the actuating lever 31 is relatively vertical and the travel bar 65 is positioned closer to the housing end 11*a* having the lever 31. As such, the first, second, and third locking elements 51, 53, 55 are positioned between the hinge plates 19, 21 and the housing 11, substantially out of registration with the respective openings 45, 47, 49 in the hinge plates 19, 21. In this travel bar locking position, the locking elements 51, 53, 55 firmly oppose any force tending to open the ring members 41 because they are generally sized, along with the travel bar 65, to fully occupy the area between the hinge plates 19, 21 and the housing's raised plateau 23. So as the hinge plates 19, 21 push up on the locking elements 51, 53, 55 (i.e., such as when the hinge plates 19, 21 pivot to open the ring members 41) the hinge plates immediately engage the locking elements 51, 53, 55, tending to force both the locking elements 51, 53, 55 and the travel bar 65 up. The housing's raised plateau 23 resists this movement, however, blocking the hinge plates' pivoting motion and preventing the ring members 41 from opening.

In order to open the mechanism 1, an operator pivots the lever 31 outward and downward (FIG. 9). This pushes the intermediate connector 79 and travel bar 65 away from the housing end 11*a* having the lever 31, and translates the travel bar 65 out of its locking position. The travel bar 65 moves until the locking elements 51, 53, 55 each substantially register with the respective second, third, and fourth openings 45, 47, 49 in the hinge plates 19, 21. At this intermediate, transitional position, the locking elements 51, 53, 55 no longer block the hinge plates' pivoting motion. This allows the wire form springs 17 to automatically act on the hinge plates 19, 21, pivoting the hinge plates 19, 21 up and through the coplanar position (and thereby overcoming any spring force of the housing 11 that resists hinge plate movement through the coplanar position) so that their openings 45, 47, 49 pass over the locking elements 51, 53, 55 and the ring members 41 open. At this open position (FIGS. 3A, 3B, 10 and 11), the cam surfaces 99 of each locking element 51, 53, 55 fully project through the hinge plates' respective openings 45, 47, 49 and the angle A between the hinge plates' exterior surfaces 103 is at its smallest. The wire form springs 17 and the housing's spring force keep the ring members 41 open, and the operator may let go of the lever 31 to load or remove paper from the mechanism 1.

Figure 2A:
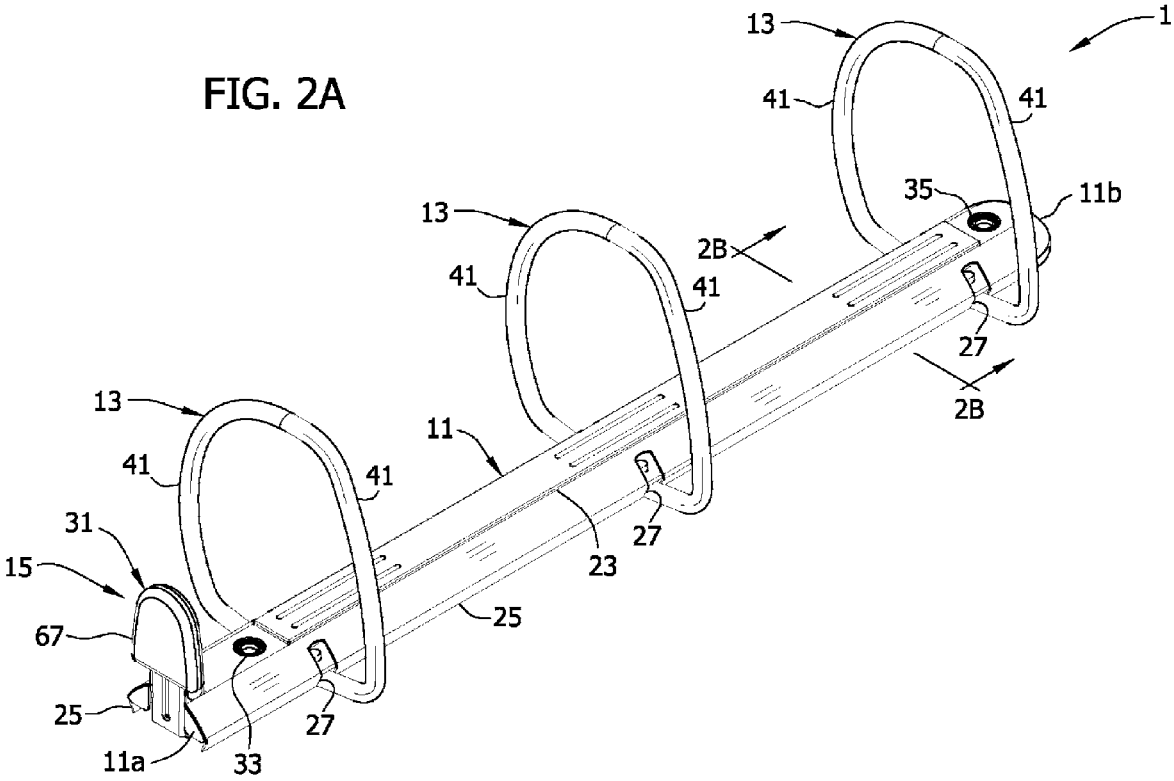
FIG. 2A is a perspective of the mechanism at a closed and locked position.
Figure 2B:
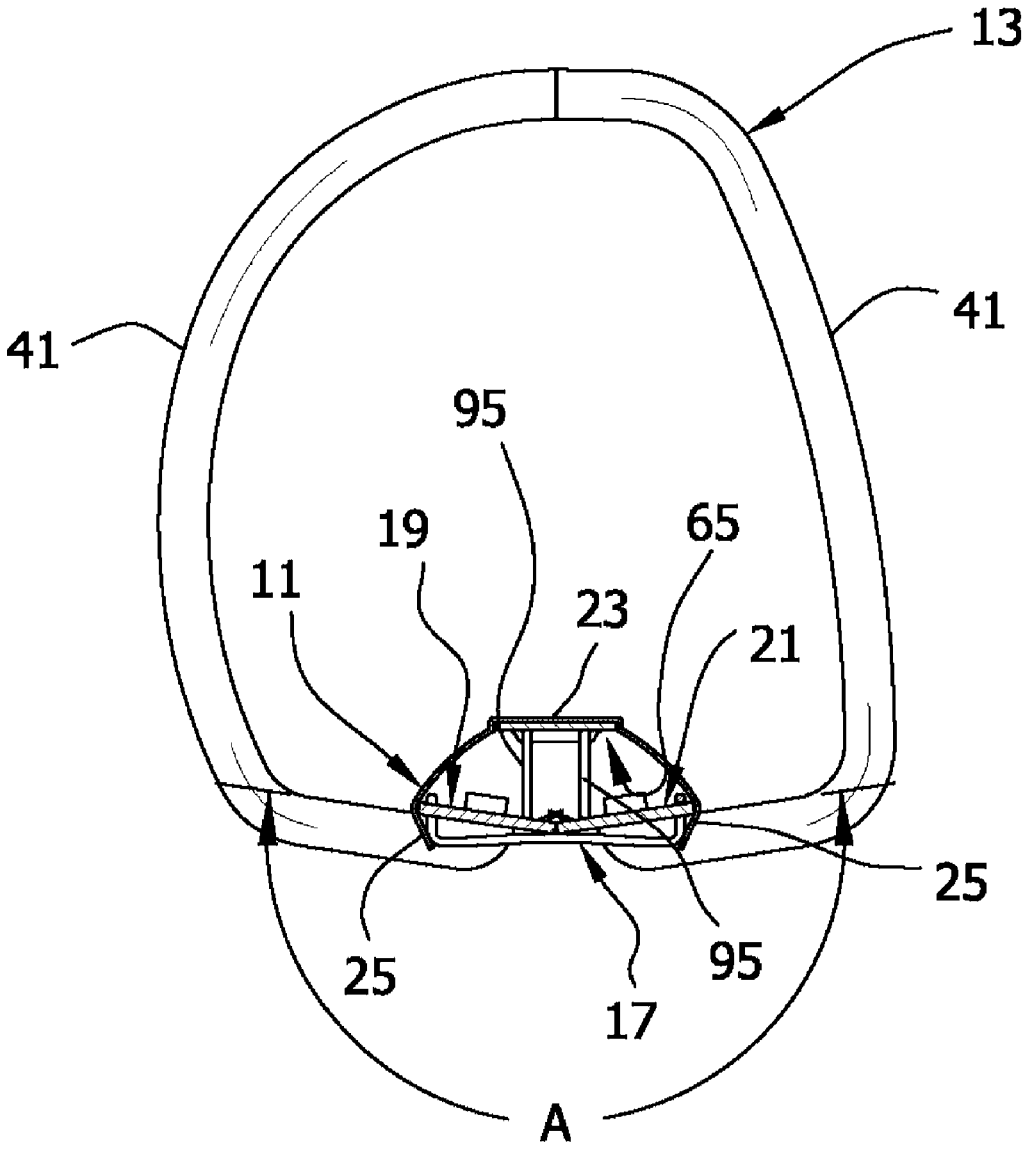
FIG. 2B is a section taken on line 2B-2B of FIG. 2A.
Figure 3A:
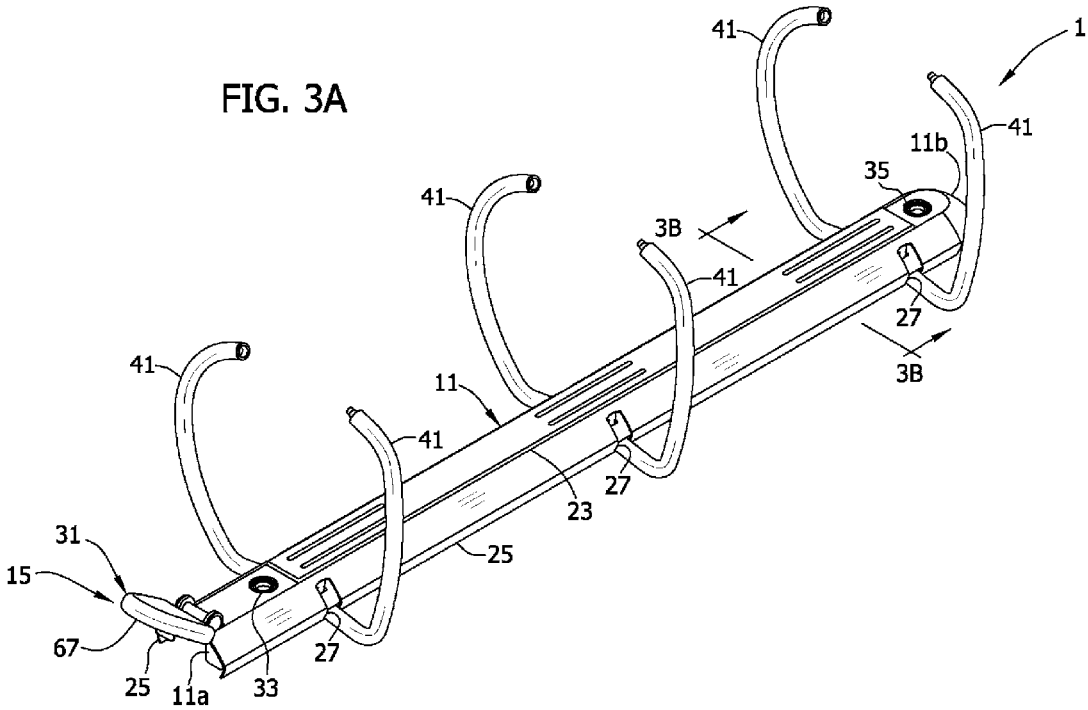
FIG. 3A is a perspective similar to FIG. 2A with the mechanism at an open position.
Figure 3B:
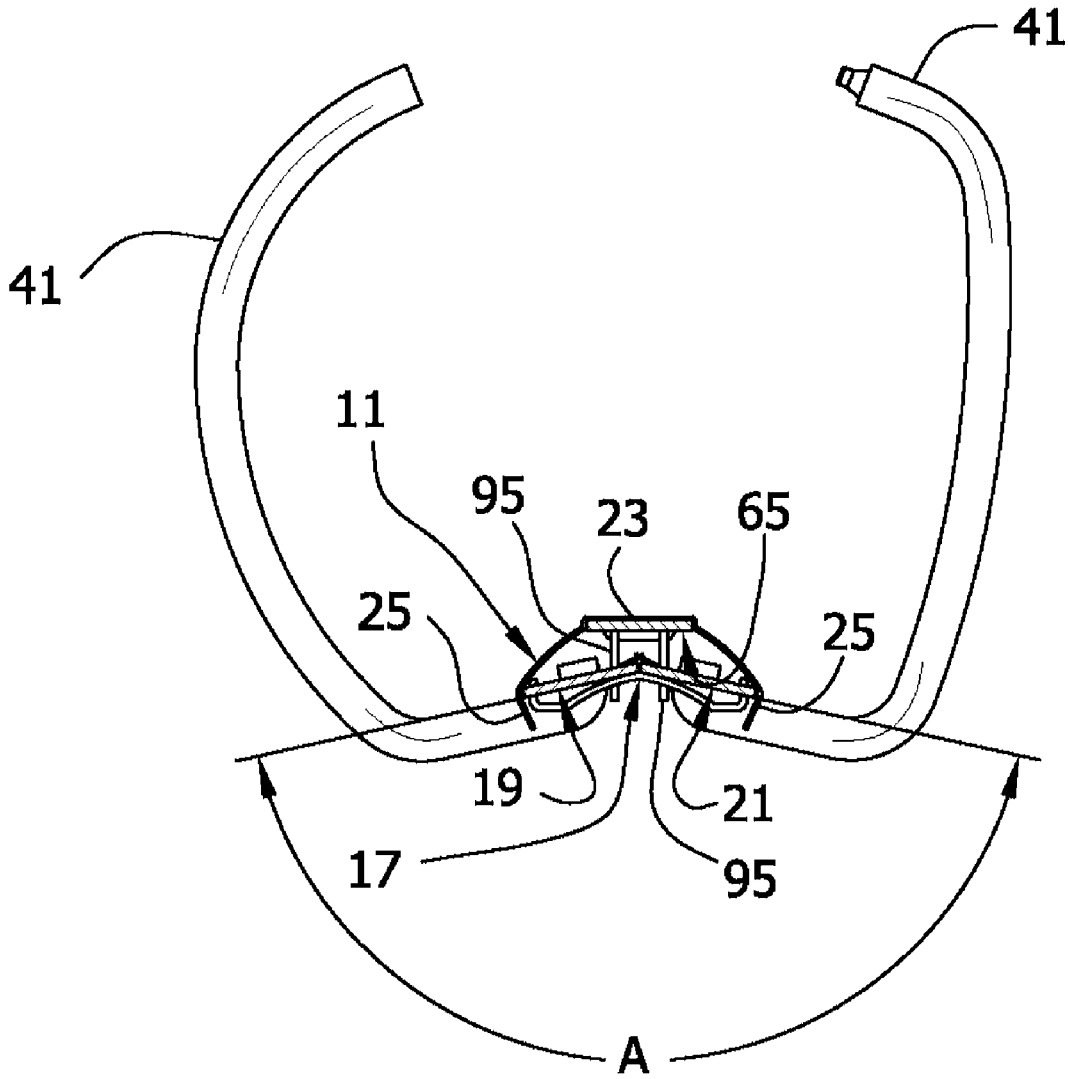
FIG. 3B is a section taken on line 3B-3B of FIG. 3A.

To return the mechanism 1 back to the closed and locked position, the operator pivots the lever 31 inward and upward (FIGS. 2A, 5, and 8). This pulls the intermediate connector 79 and travel bar 65 back toward the housing end mounting the lever 31, causing the cam surfaces 99 of the locking elements to engage the hinge plates 19, 21 at edges of the respective openings 45, 47, 49. As the operator continues pivoting the lever 31 and moving the travel bar 65, the locking elements 51, 53, 55 begin to pivot the hinge plates 19, 21, thereby overcoming forces opposing such hinge plate 19, 21 motion (i.e., a sliding friction force between the locking elements' cam surfaces 99 and the hinge plates 19, 21, the wire form spring's force resisting flattening, and the housing's spring force resisting hinge plate movement through the coplanar position). Thus, the hinge plates 19, 21 slowly slide down each cam surface 99 and softly move the ring members 41 together. Once the ring members 41 fully close, the travel bar 65 returns to its locking position and the locking elements 51, 53, 55 fully return to their position blocking the hinge plates' pivoting motion. As above described, in this mechanism 1 the locking elements 51, 53, 55 bias the hinge plates 19, 21 to pivot only for closing and locking the ring members 41. The locking elements 51, 53, 55 are incapable of moving the hinge plates 19, 21 for opening the ring members 41. This is accomplished by the wire form springs 17.

The ring binder mechanism of the present invention securely retains loose-leaf pages when the ring members 41 are closed. In this position, the locking elements 51, 53, 55 and travel bar 65 generally completely occupy the area between the hinge plates 19, 21 and the housing's raised plateau 23, and the locking elements 51, 53, 55 are positioned substantially out of registration with the respective openings 45, 47, 49 in the hinge plates 19, 21. Additionally, the housing 11 encases the locking elements 51, 53, 55, providing a barrier to outside forces from unintentionally moving the locking elements 51, 53, 55 into registration with the openings 45, 47, 49. As a result, the travel bar 65 and the locking elements 51, 53, 55 fully resist any hinge plate movement tending to open the ring members 41 and positively lock the ring members 41 together, reducing the mechanism's chance of accidentally opening. Furthermore, this mechanism 1 is easier to manipulate when the ring members 41 are full of pages. The lever 31 can move the locking elements 51, 53, 55 for unlocking the ring members 41, as opposed to some prior art mechanisms where the ring members themselves directly lock together. Moreover, the locking elements 51, 53, 55 of this mechanism distribute a locking force generally uniformly to the ring members 41 and minimize gaps between the closed members 41 because the locking elements 51, 53, 55 are uniformly spaced along the length of the hinge plates 19, 21.

This mechanism 1 also reduces the undesirable snapping motion of ring members 41 as they close because the locking elements' cam surfaces 99 control the pivoting motion of the hinge plates 19, 21. As the operator pivots the lever 31 for closing the ring members 41, the locking elements 51, 53, 55 slowly move the hinge plates 19, 21 and gently bring the ring members 41 together. The wire form springs 17 cause the hinge plates 19, 21 to pivot up and through the coplanar position for opening the ring members 41. As such, the wire form springs 17 effectively perform the same functions as the housing's spring force. Consequently, the housing's spring force may be reduced, or possibly eliminated, so that only the wire form springs 17 act on the hinge plates 19, 21. This makes it easier to move the hinge plates 19, 21 down and through the coplanar position when closing the ring members 41.

Furthermore, this mechanism 1 opens more easily than prior art mechanisms. The operator need only move the travel bar 65 a short distance before its locking elements 51, 53, 55 align with corresponding openings 45, 47, 49 in the hinge plates 19, 21 and the wire form springs 17 automatically act on the hinge plates 19, 21, pivoting them to open the ring members 41. Similarly, the lever's pivoting movement reduces the magnitude of force necessary to cause this travel bar movement because of the mechanical advantage given by the lever 31.

Figure 12:
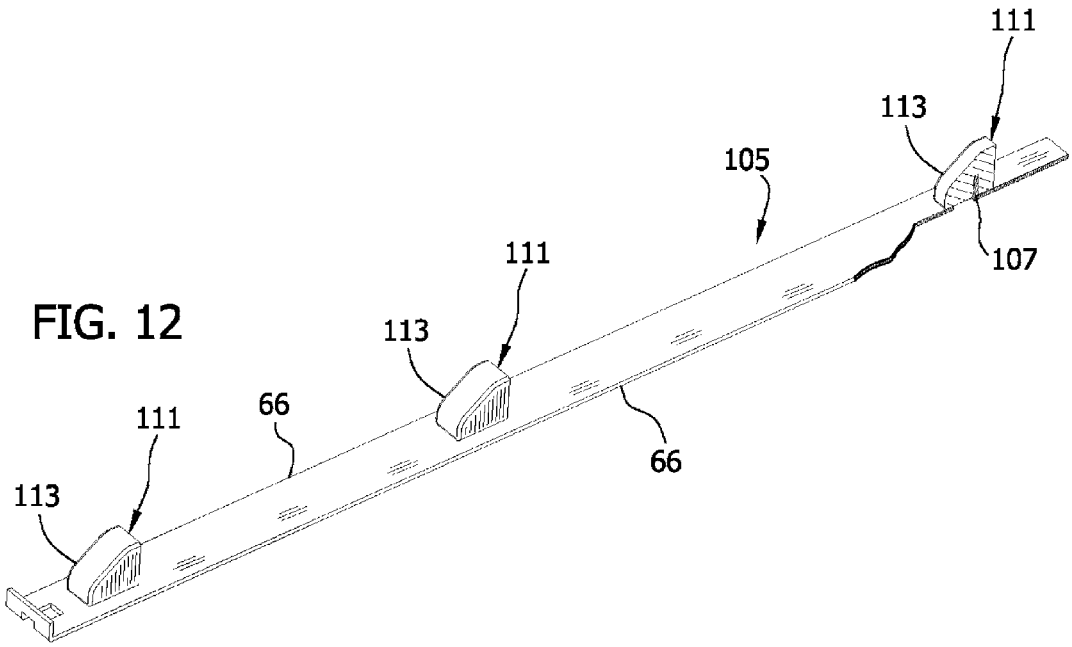
FIG. 12 is a bottom perspective of an alternative version of the travel bar with a portion of the travel bar and a portion of a locking element broken away.
Figure 13A:
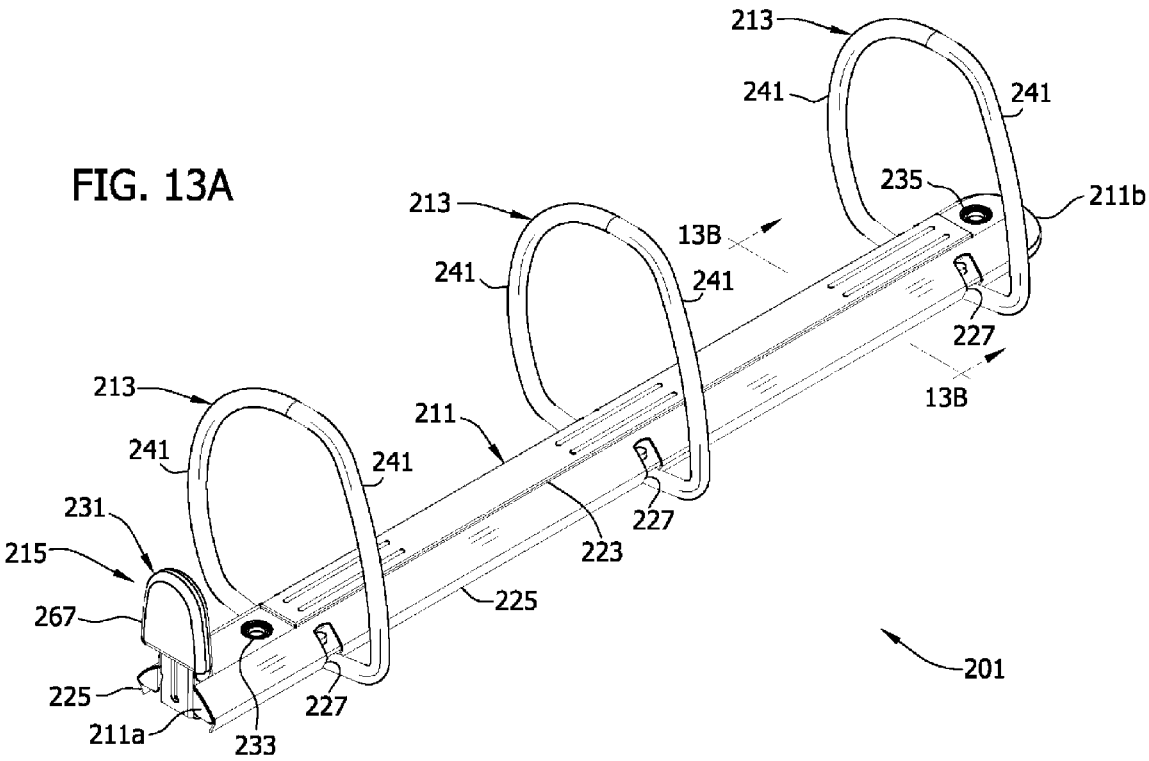
FIG. 13A is a perspective of a second embodiment of a ring binder mechanism of the present invention at a closed and locked position.
Figure 13B:
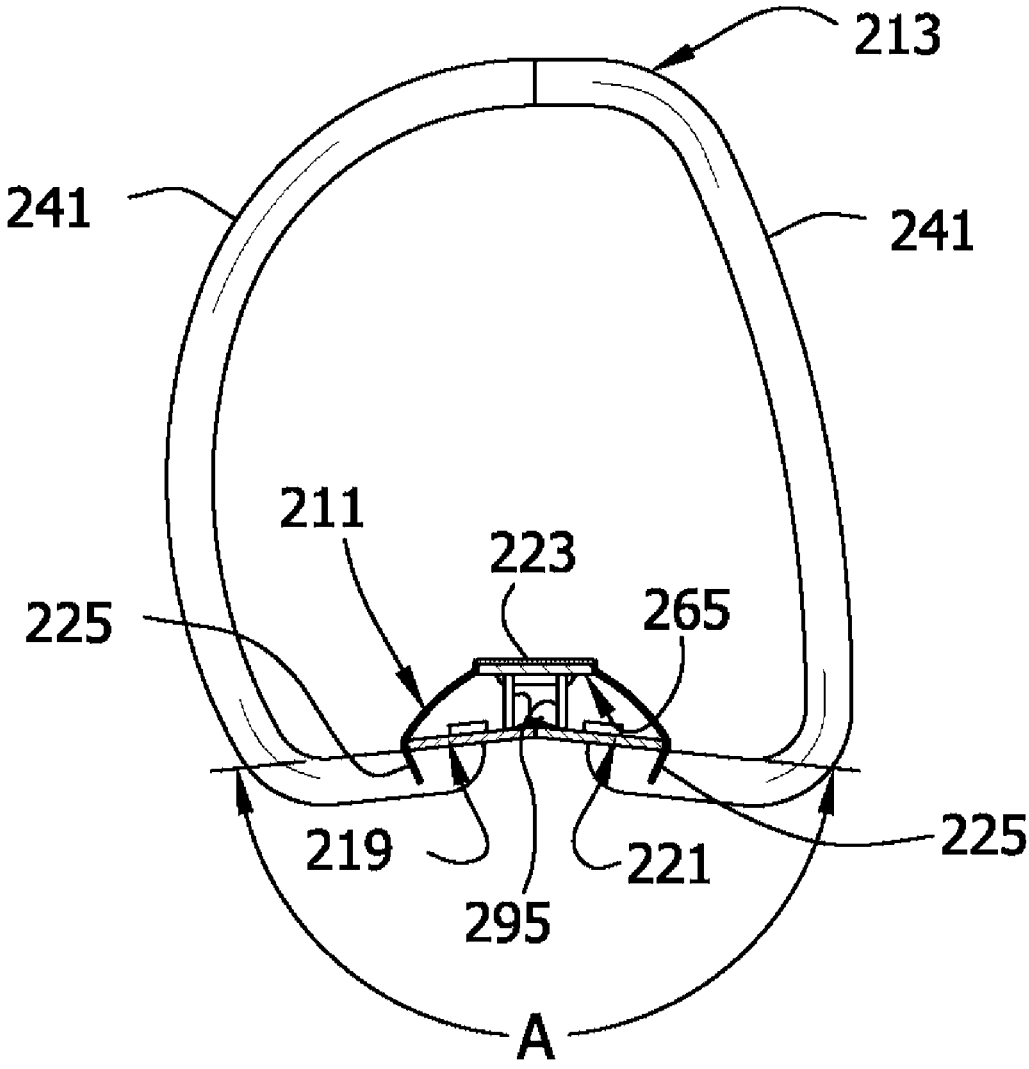
FIG. 13B is a section taken on line 13B-13B of FIG. 13A.
Figure 14A:
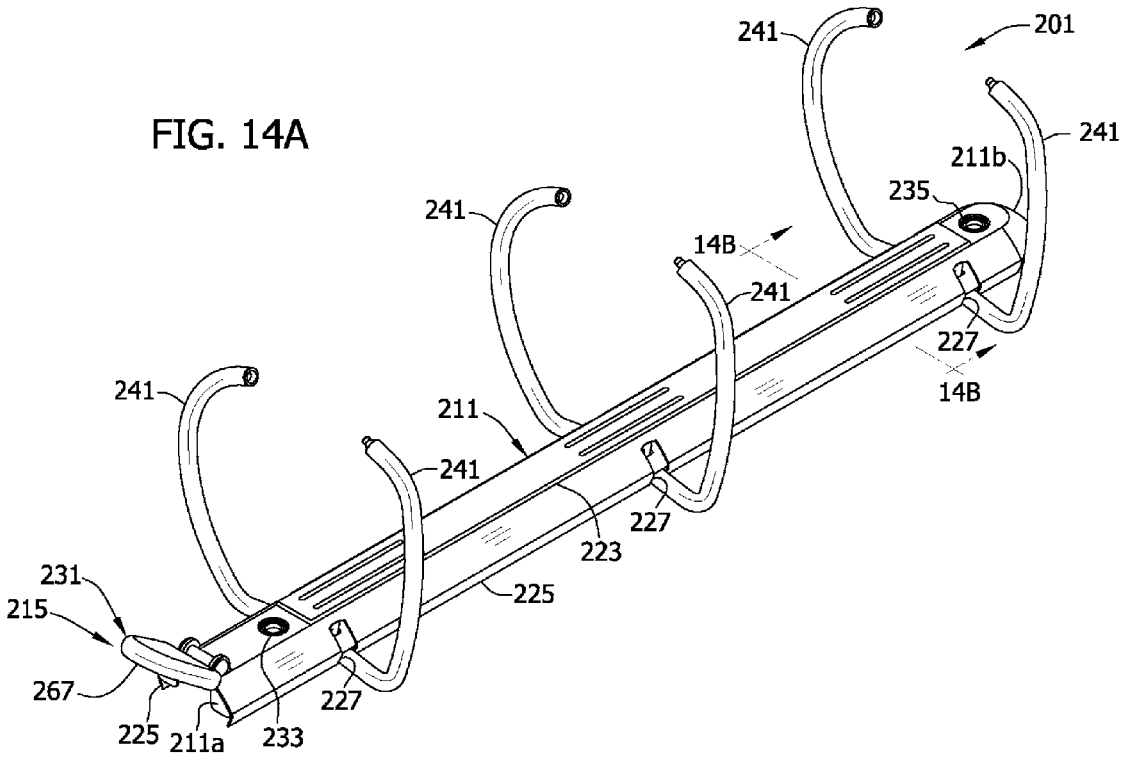
FIG. 14A is a perspective similar to FIG. 13A with the mechanism at an open position.
Figure 14B:
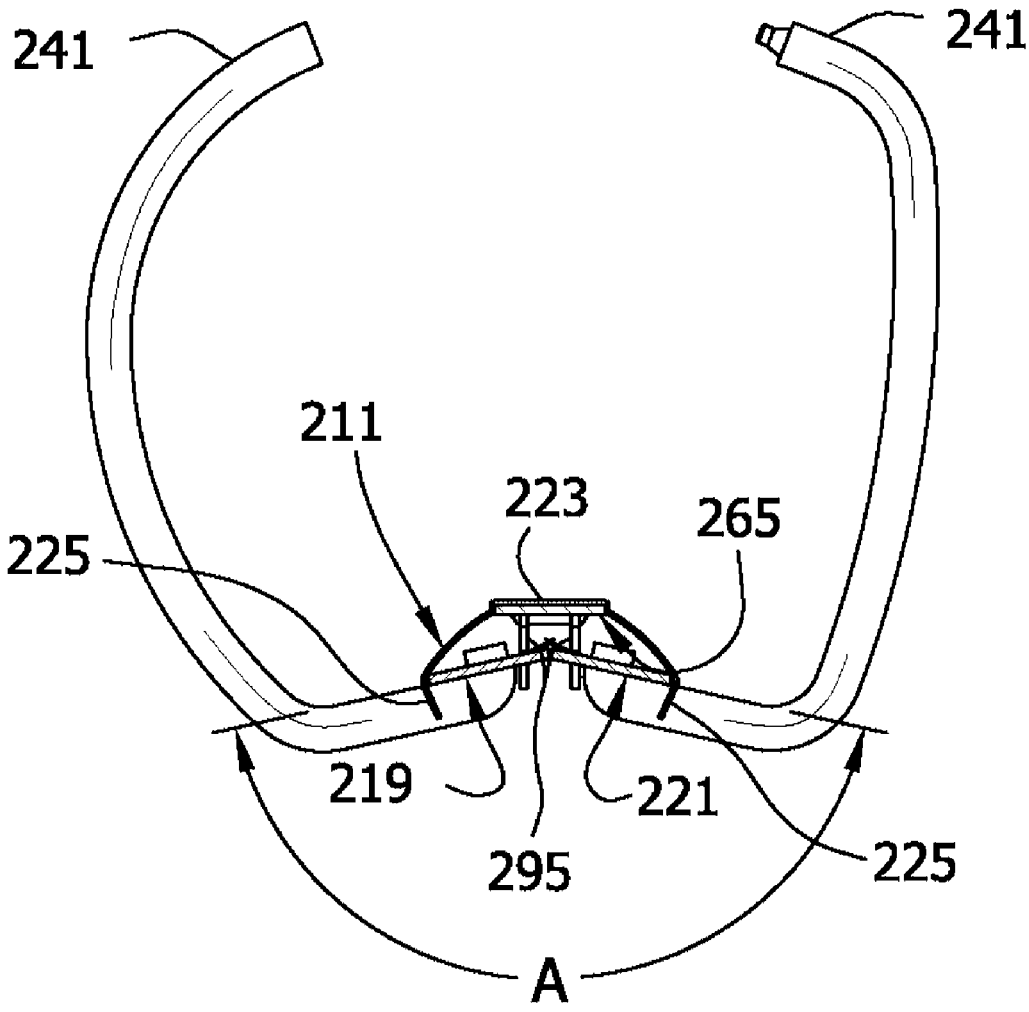
FIG. 14B is a section taken on line 14B-14B of FIG. 14A.

Now referring to FIG. 12, an alternative version of the travel bar is generally designated by reference numeral 105. This travel bar 105 includes three tabs 107 (only one of which is shown) formed as one piece with the travel bar 105. Each tab 107 is struck downward 90° from the bar's surface and is capable of receiving a locking element 111, which in this embodiment is formed separately from the travel bar 105 and secured to the tab 107. The locking element 111 is generally block-shaped and may be made of plastic or other suitable material capable of resisting the hinge plates' pivoting motion and of wedging the hinge plates 19, 21 to move the ring members 41 together. The locking element 111 also includes an angled cam surface 113 substantially similar to the cam surfaces 99 of the travel bar described for the mechanism 1 of the first embodiment. Accordingly, each embodiment described herein may include this alternative version travel bar 105.

FIGS. 13A-14B illustrate a second embodiment of the ring binder mechanism of the present invention. The mechanism of this embodiment is generally designated by reference numeral 201. Parts of the mechanism of this second embodiment corresponding to parts of the mechanism of the first embodiment are indicated by the same reference numerals, plus "200". This embodiment is substantially similar to the first embodiment, but does not include wire form springs under hinge plates. In this embodiment, a spring force of a housing 211 causes the hinge plates 219, 221 to pivot for opening ring members 241. The hinge plates 219, 221 pivot in the housing 211 so that a pivot axis never moves below a coplanar position when the ring members 241 move between a closed and an open position (i.e., an angle A (FIGS. 13B and 14B) between exterior surfaces of the hinge plates is always less than 180°). Thus, the spring force of the housing 211 only acts to open the ring members 241 and never to close the ring members. Also in this embodiment, the hinge plates 219, 221 do not include notches or a cutout along their outer longitudinal edge margins because there are no wire form springs. But in all other aspects, the hinge plates 219, 221 of this embodiment are identical to the hinge plates 19, 21 of the first embodiment.

Figure 15:
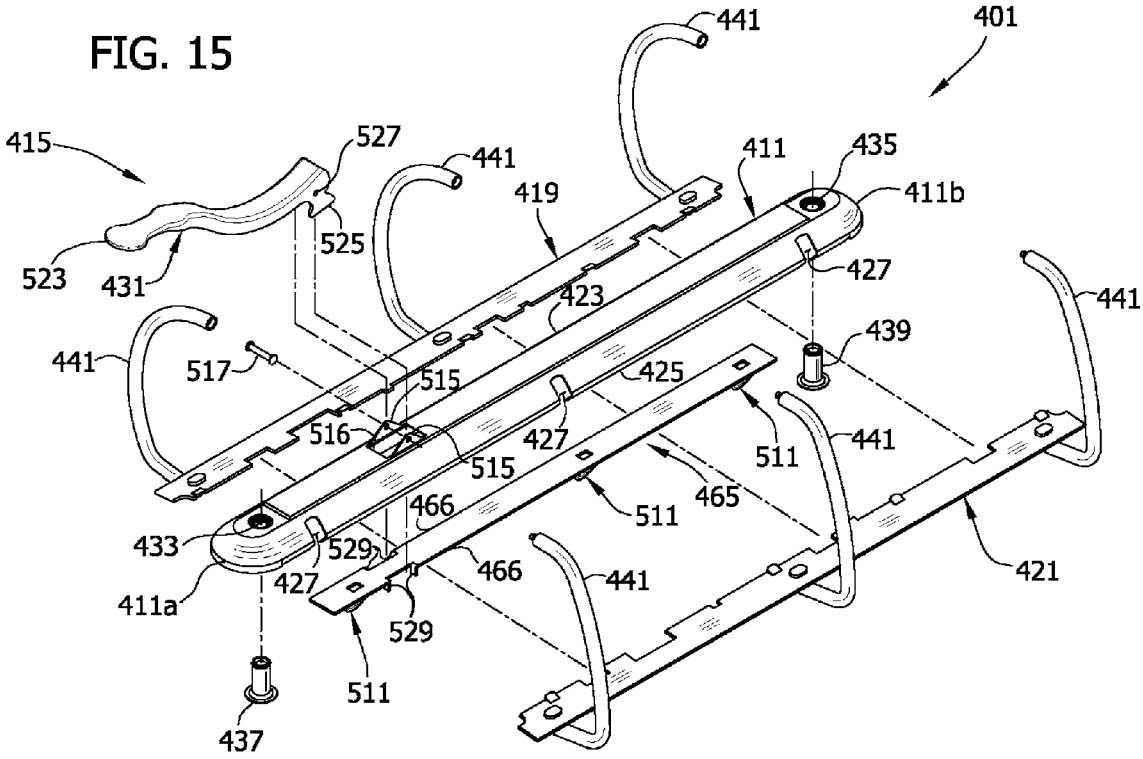
FIG. 15 is an exploded perspective of a ring binder mechanism of the present invention according to a third embodiment.
Figure 16A:
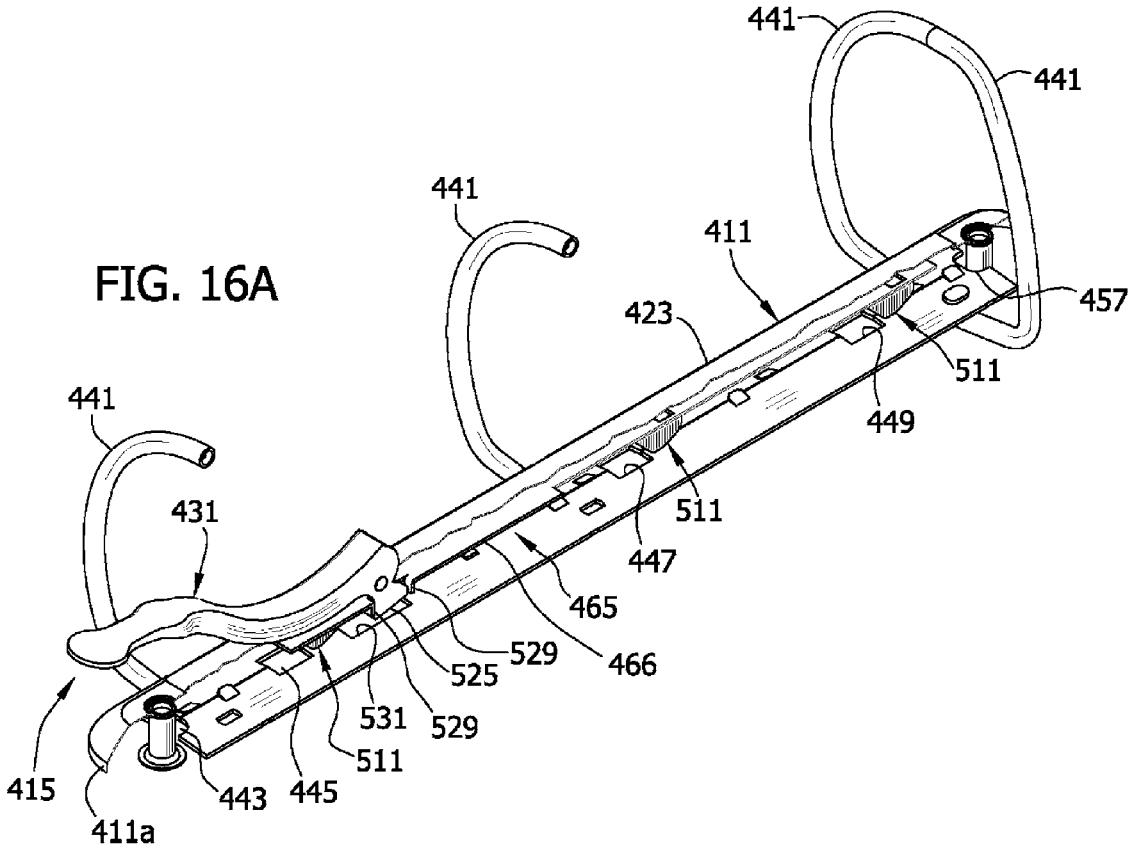
FIG. 16A is a perspective of the mechanism of FIG. 15 at a closed and locked position with a portion of a housing, a portion of a travel bar, a portion of two locking elements, and two ring members removed.
Figure 16B:
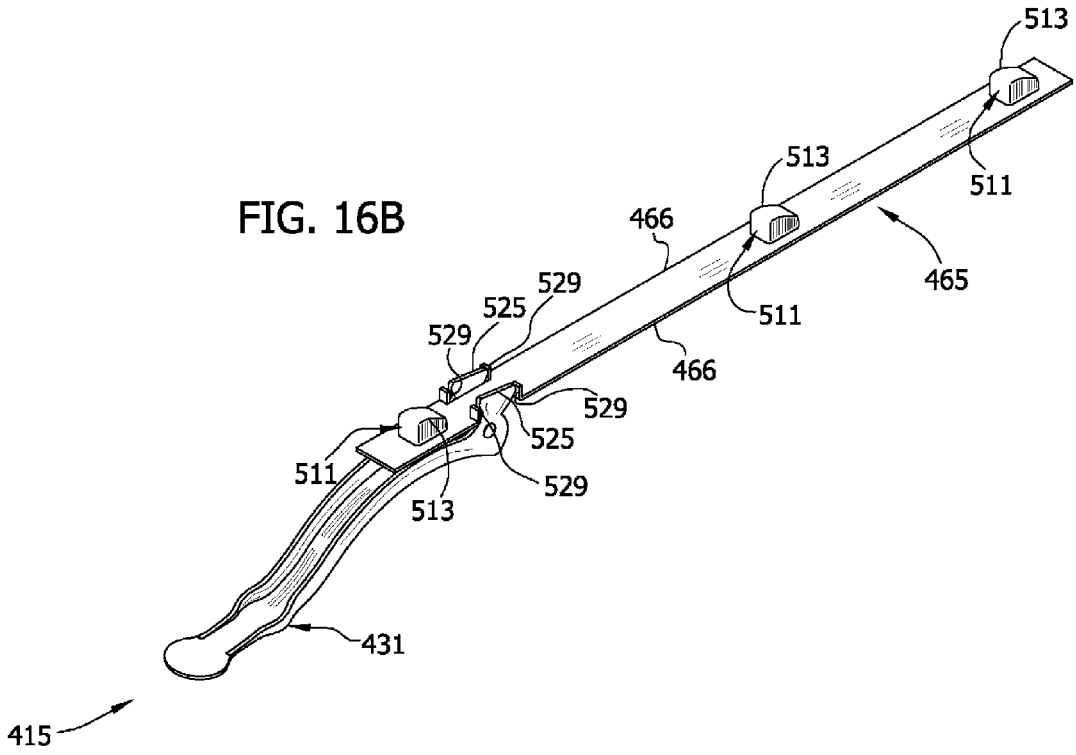
FIG. 16B is a bottom perspective of a control structure of the mechanism.
Figure 17:
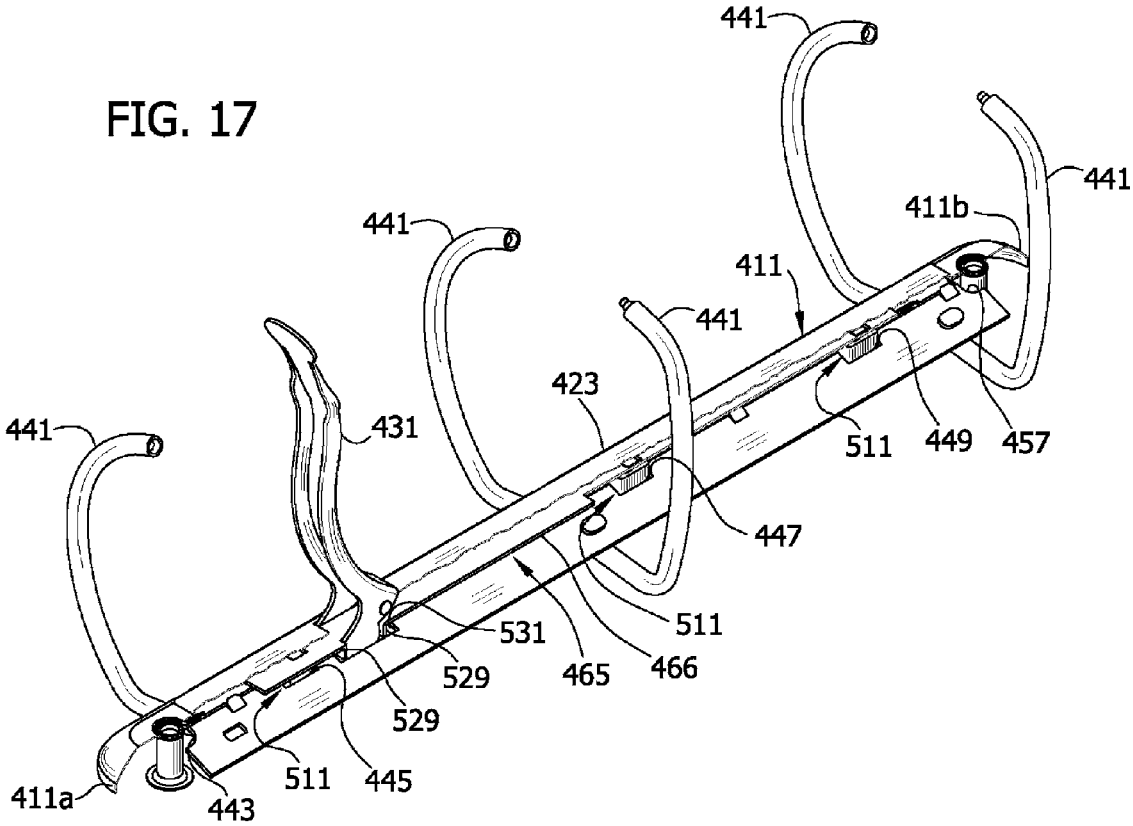
FIG. 17 is a perspective similar to FIG. 16A with the mechanism at an open position.

FIGS. 15-17 illustrate a third embodiment of the present invention. The mechanism of this invention is generally designated by reference numeral 401. Parts of this embodiment which correspond to parts of the first embodiment are indicated by the same reference numerals, plus "400". This embodiment is similar to the second embodiment in that a housing 411 supports hinge plates 419, 421 for pivoting motion such that a pivot axis of the hinge plates 419, 421 never moves to or below a coplanar position when ring members 441 move between a closed and locked position and an open position. In this embodiment, however, a lever 431 of a control structure 415 is located between two symmetrical ends of the housing 411 at opening 516 in the raised plateau 423 of the housing. To accommodate this, the housing 411 includes two tabs 515, extending upward from the raised plateau 423. The tabs 515 are capable of receiving a hinge pin 517 for pivotally mounting the lever 431 on the housing 411. In this embodiment, the lever 431 is generally an elongate, bowed beam that includes a web and two downward turned side flanges. At one end, the side flanges taper into the web, forming a flat surface 523 to grasp and pivot the lever 431. At the other end, cam surfaces 525 project downward from the side flanges. Also at this end, a hole 527 passes through both side flanges for receiving the hinge pin 517 that mounts the lever 431 on the housing 411.

The mechanism 401 of this embodiment uses no intermediate connector to transfer the lever's pivoting movement into linear movement of a travel bar. Instead, the lever's cam surfaces 525 loosely fit between opposing shoulders 529 formed in the travel bar 465 so that the lever's pivoting movement directly translates the travel bar 465 relative to the housing 411. The loose reception of each cam surface 525 between a respective pair of shoulders 529 allows the cam surfaces 525 to pivot and yet bear against one or the other of the shoulders 529 for linearly moving the travel bar 465. The shoulders 529 are located toward one end of the travel bar 465, along longitudinal edge margins 466 of the travel bar, and are positioned so that one shoulder 529 is directly opposite the other. Each shoulder 529 is formed by bending two opposing pieces downward 90° so that a plane of each piece is perpendicular to the travel bar 465. In this embodiment, the travel bar 465 does not include an end flange or a slot because there is no intermediate connector for it to receive.

Referring particularly to FIGS. 16A-17, operation of this embodiment is substantially similar to the operation of the second embodiment. In this embodiment, however, at a closed and locked position of FIG. 16A, the lever 431 is relatively horizontal and generally parallel to the housing's raised plateau 423. In order to open the ring members 441, an operator pivots the lever 431 upward and inward (i.e., toward the center pair of ring members 441). The lever's cam surfaces 525 engage the travel bar's shoulders 529 and linearly move the travel bar 465 toward the lever 431. This moves locking elements 511 into registration with corresponding openings 445, 447, 449 in the hinge plates, allowing the housing's spring force to pivot the hinge plates 419, 421 and open the ring members 441. The hinge plates 419, 421 include an additional opening 531 between second and third openings 445, 447 for receiving the lever's cam surfaces 525 and the travel bar's shoulders 529 through the interconnected plates 419, 421 (FIG. 17). Accordingly, there is no interference between the hinge plates 419, 421 and either the lever 431 or the travel bar 465 during operation. To close the ring members 441, the operator pivots the lever 431 downward and outward, reversing the opening action so that the cam surfaces 525 again bear against the shoulders 529 to move the travel bar 465 away from the lever 431. As in the second embodiment, cam surfaces 513 of each locking element 511, which in this embodiment are identical to the cam surfaces 113 of the locking elements described for the alternative version of the travel bar 105 above, engage the hinge plates 419, 421 and cause them to pivot to close the ring members 441. It is understood that while in this embodiment the housing's spring force pivots the hinge plates 419, 421 for opening the ring members 441, wire form springs may alternatively be attached to the underside of hinge plates for pivoting the plates as was described for the first embodiment.

Figure 18:
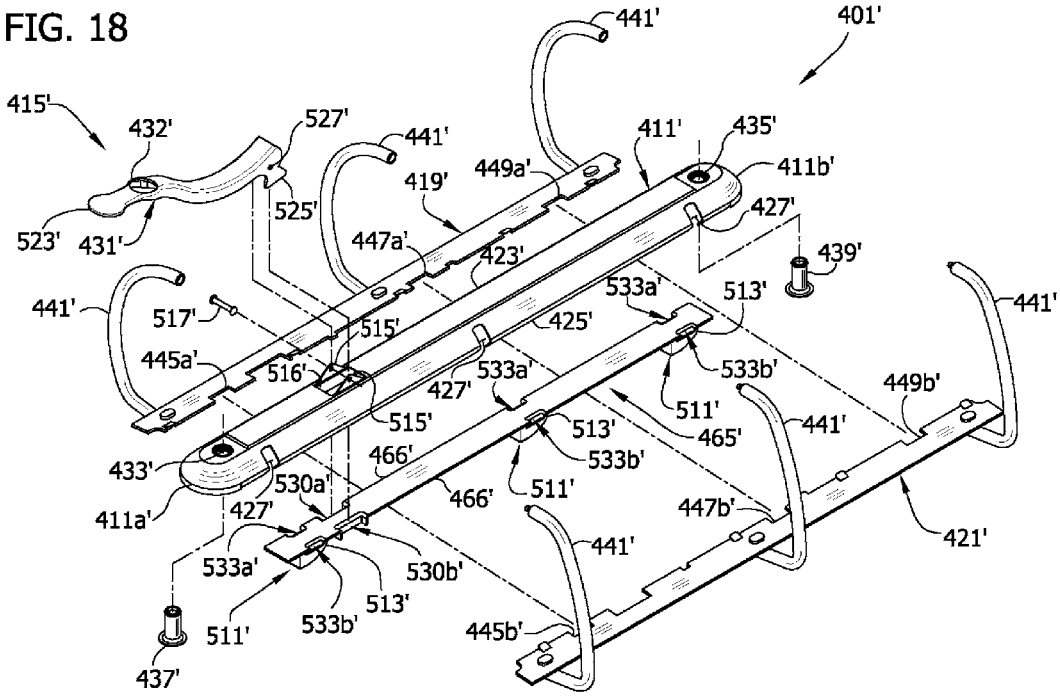
FIG. 18 is an exploded perspective of a ring binder mechanism of the invention according to a fourth embodiment.
Figure 19A:
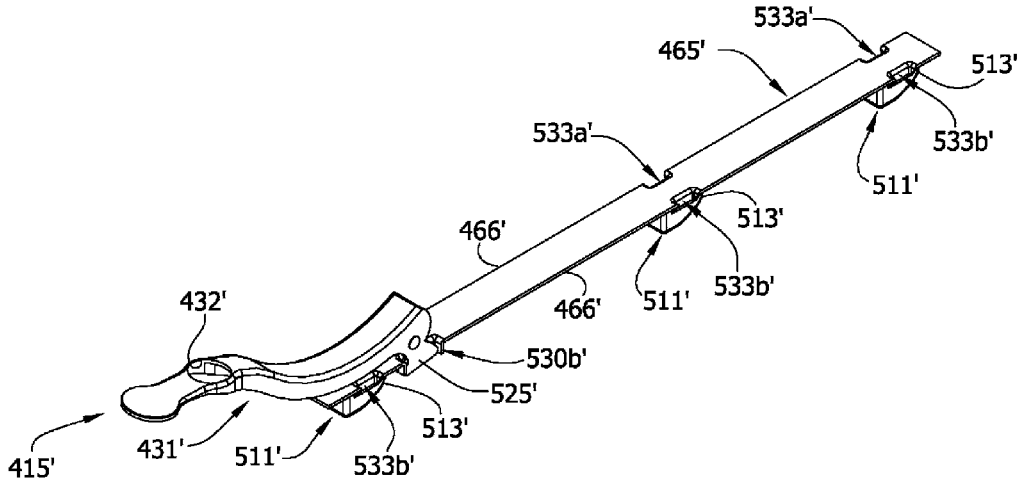
FIG. 19A is a perspective of a control structure of the mechanism of the fourth embodiment.
Figure 19B:
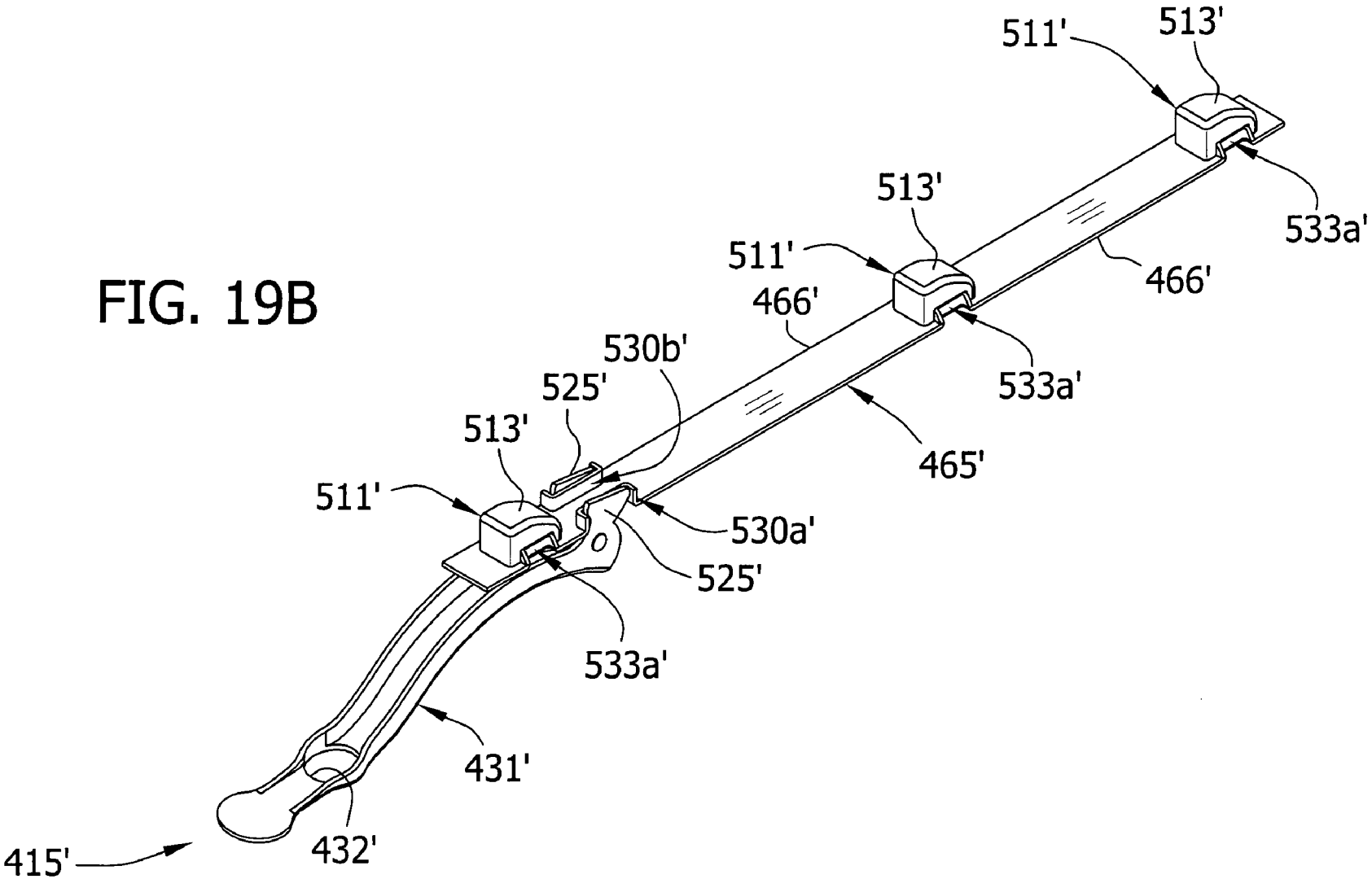
FIG. 19B is the perspective of FIG. 19A inverted.

FIGS. 18-21D illustrate a ring binder mechanism of the invention according to a fourth embodiment. The mechanism is designated generally by reference numeral 401' and is substantially the same as mechanism 401 of the third embodiment. Parts of this mechanism 401' corresponding to parts of mechanism 401 are indicated by the same reference numerals with the addition of a prime symbol. This mechanism 401' includes an alternative control structure 415' similar to control structure 415 previously described. As seen in FIGS. 18-19B, control structure 415' includes a lever 431', a travel bar 465', and three locking elements (each locking element is designated 511' and each control structure component is designated generally by its reference numeral). Here, however, the lever 431' and travel bar 465' are slightly modified. In particular, the lever includes an opening 432' for receiving a mounting post 437' therethough so that the mechanism 401' can be mounted on a cover of a binder without interference from the lever 431', and the travel bar 465' includes reinforcing structure, or ribs designated generally by reference numerals 530', 533', along its longitudinal edge margins 466'. As can be seen, ribs 530' act as a pair of shoulders to receive cam surfaces 525' of the lever 431' while ribs 533' act as mounts to receive locking elements 511'. It is to be understood that ribs 530' serve substantially the same function as do the previously described shoulders 529 of travel bar 465, but are reinforced.

Ribs 530', 533' are formed by bending a portion of the longitudinal edge margins 466' of the travel bar 431' downward from a top surface of the travel bar. This will be described in more detail hereinafter. As best seen in the bottom perspective of FIG. 20, the ribs 530', 533' are each bent downward about 90° into a channel shape. The ribs 530', 533' include two short wall sections, each designated 540', facing longitudinal ends of the travel bar 465', and longer wall sections, each designated 542', facing the longitudinal edge margins 466' of the travel bar. A height H' of each rib 530', 533' is equal to or greater than a thickness of the travel bar 465', with each rib having about the same height. More specifically, the height H' of each rib 530', 533' is between about 0.05 inches (0.127 cm) and about 0.20 inches (0.508 cm), and in the illustrated travel bar 465' is about 0.125 inches (0.3175 cm). It is to be understood that a mechanism having a reinforced travel bar in which ribs have nonuniform heights or in which different ribs have different heights or in which ribs have heights different from that illustrated does not depart from the scope of the invention. While in the preferred embodiment ribs are formed as one piece with a travel bar, a mechanism having a travel bar in which ribs are formed separately from the travel bar does not depart from the scope of the invention.

Figure 20:
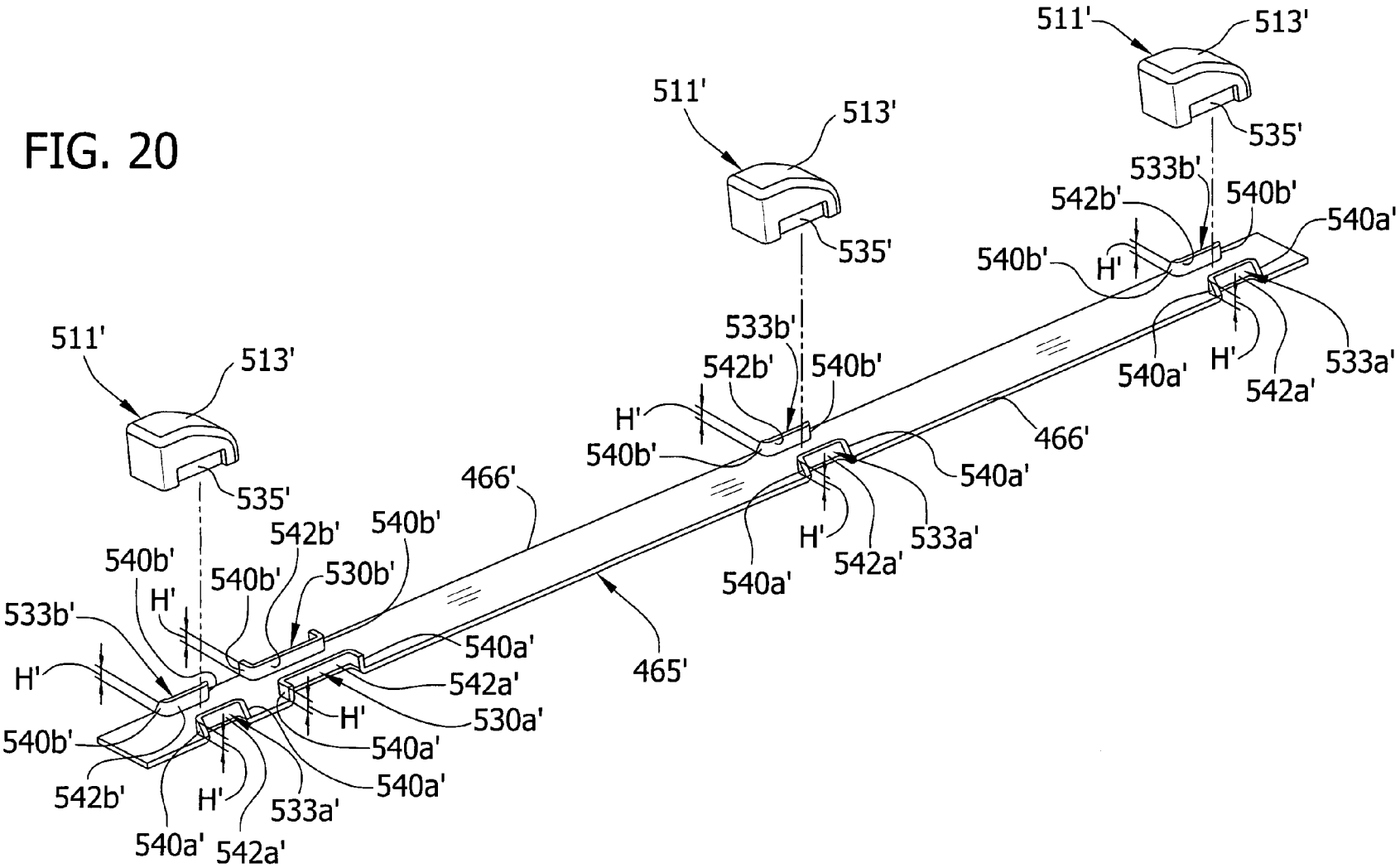
FIG. 20 is an exploded perspective of a travel bar and locking elements of the control structure of FIG. 19B.

FIG. 20 also shows that the travel bar 465' includes two of ribs 530' and six of ribs 533', each oriented in transversely opposed pairs with one rib of each pair located on opposing longitudinal edge margins 466' of the travel bar 465'. For convenience, the ribs 530', 533' of each pair and their components are designated by the letters "a" and "b" in the drawings; this does not require a particular orientation of the ribs. Ribs 533' are spaced uniformly along the travel bar 465' so that they are located generally adjacent ring members 441' (see FIG. 18). Ribs 530' are located toward an end of the travel bar 465', spaced inward from the end pair of ribs 533', and are generally in line with opening 516' of housing raised plateau 423' to facilitate placement of the lever 431' through the housing 411' and into engagement with the travel bar 465'. It is understood that a mechanism having a travel bar with a different number of ribs than illustrated does not depart from the scope of the invention.

The locking elements 511' received by ribs 533' are also shown in FIG. 20. As in the previous embodiments, three locking elements 511' are used for moving into and out of registration with openings formed in interconnected hinge plates 419', 421' by cutouts 445*a*', 445*b*', 447*a*', 447*b*', 449*a*', 449*b*' (see FIG. 18) for opening and closing ring members 441'. As illustrated, each locking element 511' is generally wedge shaped and includes an angled cam surface 513', which serves the same purpose as cam surfaces 513 of each previously described locking elements 511 of mechanism 401. A tongue 535' is located on an opposite side of the locking element 511' from the cam surface 513' and is recessed into the locking element at both sides of the element. As can be seen, the tongue 535' is sized and shaped to provide a secure fit for each locking element 511' between the pairs of corresponding ribs 533', thus mounting each locking element onto the travel bar 465'. A mechanism with greater or fewer than three locking elements or a mechanism in which the locking elements are integral with the travel bar does not depart from the scope of the invention.

Figures 21A, 21B, 21C, 21D:
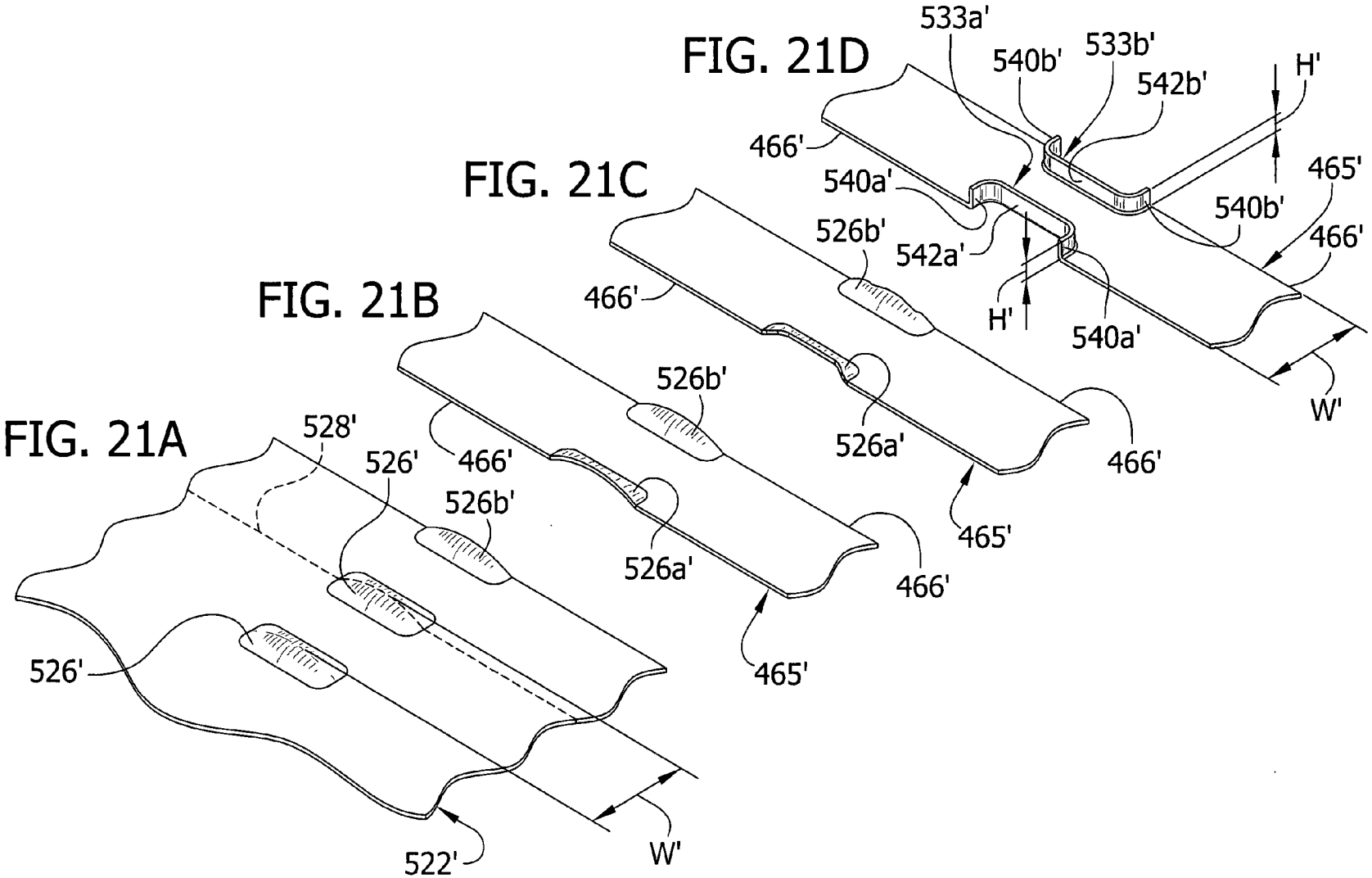
FIG. 21A is an enlarged and fragmentary bottom perspective of a sheet of material having adjacent indentations therein and used to form the travel bar of the fourth embodiment.
FIG. 21B is an enlarged and fragmentary bottom perspective of the travel bar after being cut from the sheet of material of FIG. 21A.
FIG. 21C is similar to FIG. 21B with half indentations of the travel bar partly formed into ribs.
FIG. 21D is similar to FIG. 21C with the half indentations formed into ribs.

FIGS. 21A-21D schematically illustrate formation of reinforcing structure (e.g., ribs 533*a*', 533*b*') of the travel bar 465' of mechanism 401'. In particular, they schematically illustrate the formation of one pair of ribs 533*a*' and 533*b*' at longitudinal edges 466' of travel bar 465' (FIG. 21D). As shown in the drawings, the travel bar 465' is formed from a generally flat, thin sheet of material (e.g., sheet metal), which is indicated generally at reference numeral 522' in FIG. 21A. Mounded indentations 526' are formed at spaced apart locations on the sheet 522' generally by stamping or punching a portion of one side of the sheet. Two full indentations 526' and one half indentation 526*b*' are shown in FIG. 21A. The indentations 526' do not penetrate, or pass through, sheet 522' when they are formed, but do deform the sheet in a rounded manner. Stamping and punching methods known in the art of metal working may be used to form the indentations 526'. Methods other than stamping or punching may be used without departing from the scope of the invention.

As can be seen, each indentation is substantially the same. Each is generally elongate in shape having an arch-shaped cross-section, as taken transverse to a longitudinal axis of the indentation. Also shown in the drawings, and in particular through comparison of FIGS. 21A and 21D, is that adjacent indentations 526' are laterally spaced on sheet 522' (center to center spacing) at a distance W' which is about equal to a width W' of each formed travel bar 465'.

Referring now to FIGS. 21A and 21B, after forming adjacent indentations 526' in sheet 522', the sheet is cut generally along the longitudinal axis of each indentation. The cut is illustrated by broken line 528' through indentation 526' in FIG. 21A. The cut forms a generally elongate and rectangular strip of material (FIG. 21B) that is the travel bar 465', and bisects the indentation 526' into the two half indentations 526*a*', 526*b*'. The half indentations of each indentation are generally symmetrical and are positioned on opposing longitudinal edge margins 466' of consecutively produced travel bars 465' (FIGS. 21B and 21C). Each travel bar therefore includes one half indentation 526*a*' from a first indentation 526' and one half indentation 526*b*' from a second, adjacent indentation.

With reference now to FIGS. 21B-21D, half indentations 526*a*', 526*b*' are shaped into ribs 533*a*', 533*b*' by bending and/or folding the edge margin 466' of the travel bar 465' at the half indentations. Known methods of metal working may be used to form wall sections 540*a*', 540*b*', 542*a*', 542*b*' of each rib 533*a*', 533*b*'. While FIGS. 21A-21D illustrate formation of ribs 533*a*', 533*b*', it is understood that formation of ribs 530*a*', 530*b*' is done in substantially the same way. In addition, while formation of only one pair of ribs 533*a*', 533*b*' is illustrated, it is understood that multiple indentations 526' may be formed in sheet 522' in longitudinal rows. In each row, the longitudinal axes of the multiple indentations align. Multiple rows of indentations 526' may also be formed on sheet 522' with corresponding indentations of adjacent rows spaced laterally apart distance W'. In this manner, multiple reinforced travel bars 465' may be formed with multiple ribs 530*a*', 530*b*', 533*a*', 533*b*' from sheet 522. An example is the travel bar 465' shown in FIG. 20. It is understood that in forming reinforced travel bars 465' of the invention, indentations 526' may be formed in sheet 522' at a first processing step and then subsequently transferred to the cutting step. Also, indentations 526' may be formed in sheet 522' just prior to cutting such that both are done in the same general step.

The ribs 533' of travel bar 465' are beneficial for at least the following reasons. They are channel shaped and therefore provide an effectively thicker travel bar dimension at the rib locations. This helps reinforce the travel bar 465' for resisting bending about an axis extending lengthwise of the travel bar and to resist bending about an axis widthwise of the travel bar. Since ribs 533' correspond to the location of the locking elements 511', the increased thickness at these locations is desirable for improving the travel bar's resistance to deforming during repeated engagement with the hinge plates 419', 421' during operation. Therefore, the travel bar 465' of the invention is less likely to deform and fail after repeated use, and ring mechanisms incorporating the travel bar are more durable. Accordingly, problems resulting from deformation of travel bars such as an inability of the bar to fully pivot the hinge plates to close the ring members, an inability to fully move the closed ring members together to prevent gaps between the closed ring members, or an inability to lock the closed ring members together are avoided.

The channel-shaped ribs 533' also improve locking force holding closed ring members 441' together. As was previously described for control structure 415, when control structure 415' is incorporated into mechanism 401' and the mechanism is in a closed and locked position, any force tending to pivot the hinge plates 419', 421' upward to open the ring members 441' is resisted by the locking elements 511', travel bar 465', and housing 411'. Because reinforcing ribs 533' are located at the locking elements 511', this resistance is improved, thus preventing the travel bar 465' from inadvertently bending at the locking elements under upward movement of the hinge plates 419', 421'. Accordingly, the control structure 415' can resist greater forces attempting to open locked ring members 441' without damage to the ring binder mechanism 401'.

Ribs 530' are also beneficial in providing improved strength to the travel bar 465' to resist repeated lever movement. During operation, the cam surfaces 525' of the lever 431' repeatedly engage short wall sections 540' of ribs 530' to drive the travel bar 465' lengthwise of the housing 411'. The channel shape of the ribs 530' improves resistance to these driving forces because the short wall sections 540' of the rib are connected via the channel shape of the rib 530' (i.e., longer wall sections 542'). This prevents the short wall sections 540' from bending or otherwise deforming upon repeated operation, as may occur in prior art mechanisms where lever cam surfaces bias single opposing shoulders cut and bent from a travel bar.

A further benefit of ribs 530', 533' is derived from formation of the ribs by bending a portion of the travel bar 465' downward. This increases overall strength of the travel bar 465' because the bent ribs 530', 533' are integral with the travel bar. Therefore, the ribs 530', 533' retain much of the inherent material strength of the travel bar 465' after being formed. In contrast, forming similar reinforcing structure by cutting portions of a travel bar can weaken the travel bar at the cuts such that the travel bar actually loses strength. Moreover, the ribs 530', 533' provide strength without requiring the overall thickness of the travel bar 465' to increase, or requiring a particularly rigid material to be used for the travel bar.

Figure 22:
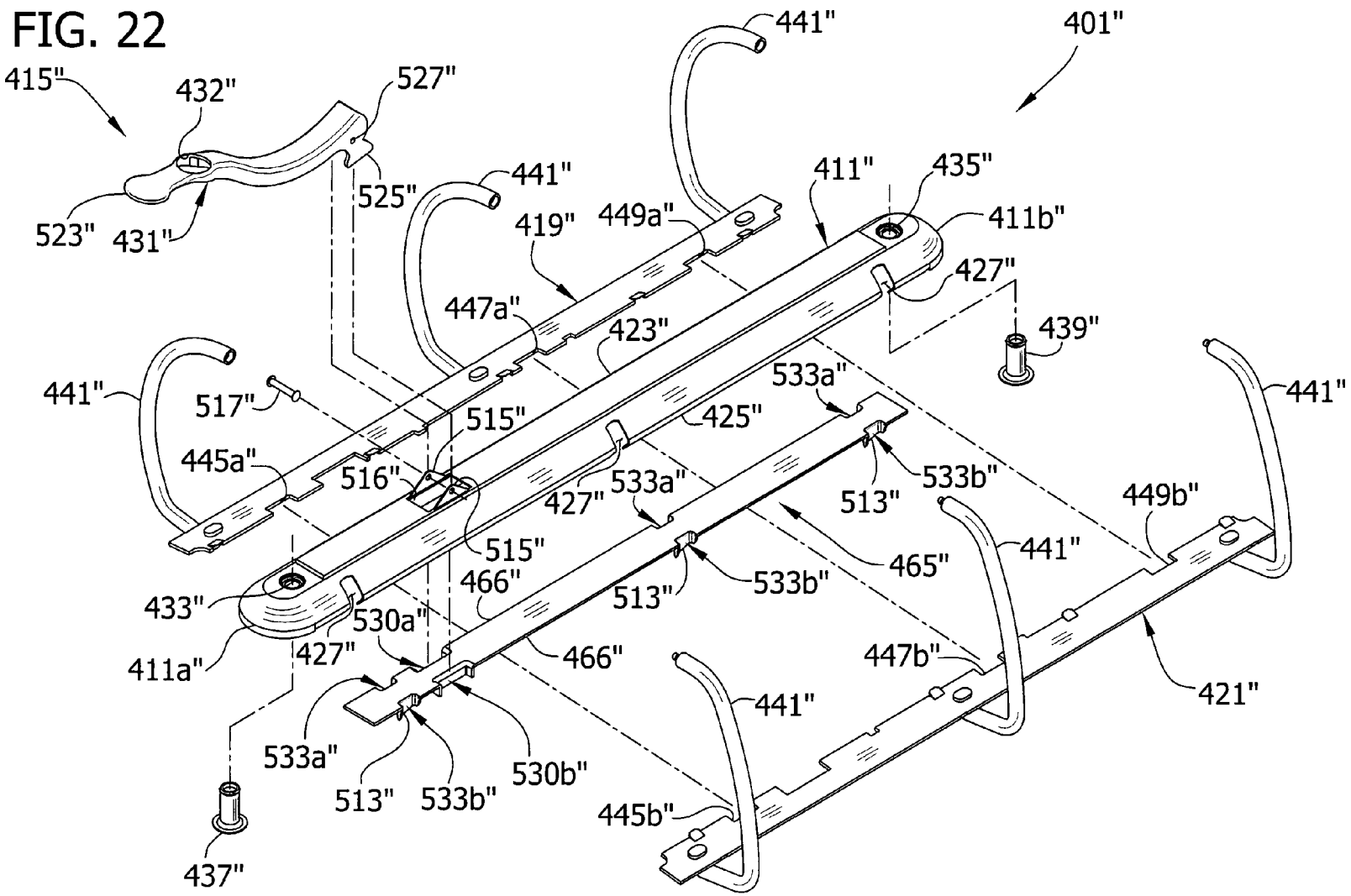
FIG. 22 is an exploded perspective of a ring binder mechanism of the invention according to a fifth embodiment.
Figure 23:
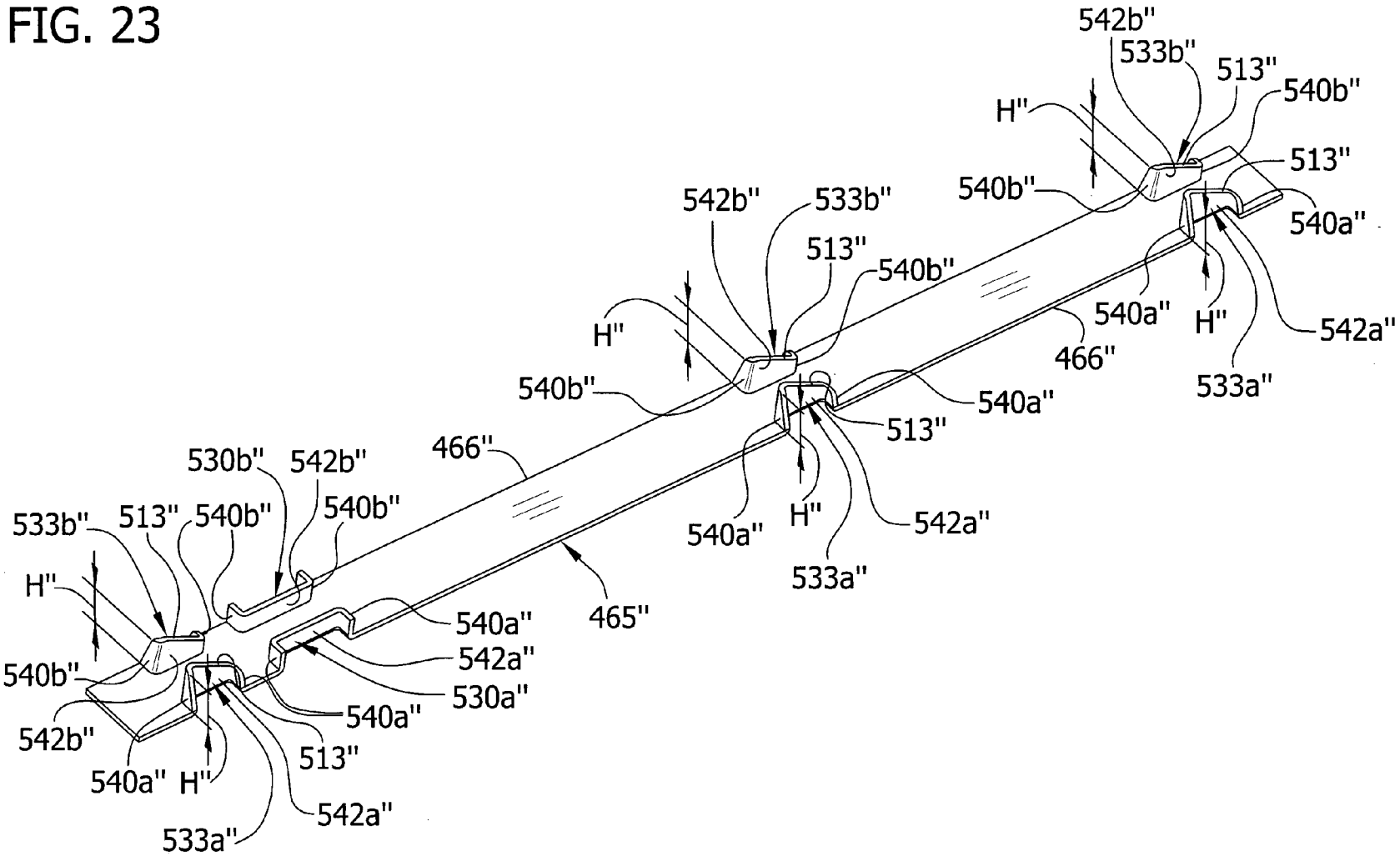
FIG. 23 is a bottom perspective of a travel bar of the mechanism.

Referring now to FIGS. 22 and 23, a fifth embodiment of the invention is shown generally at reference numeral 401". The mechanism 401" of this embodiment is again substantially the same as mechanism 401 and parts of this mechanism corresponding to parts of mechanism 401 are designated by the same reference numerals with the addition of a double prime symbol. A travel bar 465" of this mechanism 401" is illustrated in which locking elements 511" are integral with the travel bar. More specifically, locking elements 511" are defined by the ribs 533" of the travel bar 465". Here, a height H" of each rib 533" is nonuniform so that each rib 533" is angled, thus allowing it to serve as a cam surface 513", with each pair of corresponding ribs 533*a*" and 533*b*" serving as one locking element 511" for operation of the mechanism 401 (a height of each rib 530" is the same as previously described for ribs 530' of mechanism 401'). It is understood that each mechanism described herein may be modified to include a reinforced travel bar similar to bar 465" without departing from the scope of the invention.

Components of the mechanism of the present invention according to the several discussed embodiments are made of a suitable rigid material, such as metal (e.g., steel). But mechanisms made of a nonmetallic material, specifically including plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations thereof is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing having longitudinal ends;

hinge plates supported by the housing for pivoting motion relative to the housing, the hinge plates including at least one opening;

rings for holding loose-leaf pages, each ring including a first ring member mounted on a first hinge plate and moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings;

a travel bar movable in translation relative to the housing and the hinge plates, the travel bar having two longitudinal edge margins;

a locking element moveable with the travel bar, the locking element engaging at least one of the hinge plates and producing the pivoting motion of the hinge plates when the locking element moves from a position in registration with said opening in the hinge plates to a position substantially out of registration with said opening; and the travel bar including reinforcing structure constructed and arranged to resist bending about an axis extending lengthwise of the travel bar and to resist bending about an axis widthwise of the travel bar for rigidifying the travel bar.

2. A ring binder mechanism as set forth in claim 1 wherein at least part of the reinforcing structure is located adjacent to the locking element.

3. A ring binder mechanism as set forth in claim 1 wherein the reinforcing structure is located adjacent at least one of the longitudinal edge margins of the travel bar.

4. A ring binder mechanism as set forth in claim 3 wherein the reinforcing structure comprises at least one rib.

5. A ring binder mechanism as set forth in claim 4 wherein the rib includes a wall section extending generally lengthwise of the travel bar and a wall section extending generally widthwise of the travel bar.

6. A ring binder mechanism as set forth in claim 5 wherein the rib further comprising another wall section extending widthwise of the travel bar, the rib having a generally channel shape.

7. A ring binder mechanism as set forth in claim 4 wherein the rib is formed as one piece of material with the travel bar.

8. A ring binder mechanism as set forth in claim 7 wherein the rib is formed by deforming a portion of the travel bar downward about 90°.

9. A ring binder mechanism as set forth in claim 4 wherein a height of the rib is equal to or greater than a thickness of the travel bar.

10. A ring binder mechanism as set froth in claim 9 wherein a height of the rib is between about 0.05 inches and about 0.20 inches.

11. A ring binder mechanism as set forth in claim 4 wherein the locking element is attached to and in contact with the rib for engaging the hinge plates.

12. A ring binder mechanism as set forth in claim 11 wherein there are multiple locking elements and two ribs associated with each locking element, each locking element having a generally wedge shape.

13. A ring binder mechanism as set forth in claim 4 wherein the locking element comprises a generally wedge-shaped formation on the rib.

14. A ring binder mechanism as set forth in claim 1 further comprising a lever mounted on the housing between the longitudinal ends of the housing.

15. A ring binder mechanism as set forth in claim 14 wherein the reinforcing structure comprises a wall section, the lever being arranged to directly contact the wall section for engaging the travel bar and causing the travel bar movement.

16. A ring binder mechanism as set forth in claim 1 wherein the movement of the locking element from the position in registration with the opening in the hinge plates to the position out of registration with said opening pivots the hinge plates to move the ring members to the closed position.

17. A ring binder mechanism as set forth in claim 16 wherein the locking element blocks the pivoting motion of the hinge plates when in the position substantially out of registration with the opening in the hinge plates.

18. A ring binder mechanism as set forth in claim 17 further comprising a spring for pivoting the hinge plates to open the ring members when the locking element moves to the position in registration with the opening in the hinge plates.

19. A ring binder mechanism as set forth in claim 17 wherein the hinge plates are supported by the housing such that an angle formed by exterior surfaces of the hinge plates never passes through 180° during the pivoting motion of the hinge plates.

20. A ring binder mechanism as set forth in claim 1 in combination with a cover, the ring binder mechanism being mounted on the cover, the cover being hinged for movement to selectively cover and expose loose-leaf pages retained on the ring binder mechanism.

21. A ring binder mechanism as set forth in claim 1 wherein the travel bar comprises a thin, flat bar having opposite major surfaces, the reinforcing structure comprising ribs projecting outward from one of the major surfaces of the travel bar and spaced apart along one of the longitudinal edge margins of the travel bar, the longitudinal edge margin including the ribs being free of ribs along a majority of a length of the travel bar.

22. A ring binder mechanism as set forth in claim 21 wherein the reinforcing structure of the travel bar further comprises ribs projecting outward from said one major surface of the travel bar and spaced apart along an opposite one of the longitudinal edge margins of the travel bar, the opposite longitudinal edge margin being free of ribs along a majority of the length of the travel bar.

23. A ring binder mechanism as set forth in claim 1 wherein the reinforcing structure comprises a rib including a first wall section extending widthwise of the travel bar from a longitudinal edge of the travel bar, the travel bar having opposite longitudinal ends and the first wall section being located inward from both longitudinal ends of the travel bar.

24. A ring binder mechanism as set forth in claim 23 wherein the rib further includes a second wall section extending from the first wall section lengthwise of the travel bar.

25. A ring binder mechanism as set forth in claim 24 wherein the ribs include a third wall section extending from the second wall section widthwise of the travel bar, the first and third wall sections being in opposed, spaced relation.

26. A ring binder mechanism as set forth in claim 1 wherein the reinforcing structure comprises a rib including a wall section formed from the travel bar and extending lengthwise of the travel bar, the travel bar having a recess from a longitudinal edge of the travel bar to the wall section.

27. A ring binder mechanism set forth in claim 26 wherein the wall section tapers in height over at least a portion of the wall section.

* * * * *

UNITED STATES PATENT AND TRADEMARK OFFICE

CERTIFICATE OF CORRECTION

PATENT NO. : 7,661,898 B2
APPLICATION NO. : 10/905031
DATED : February 16, 2010
INVENTOR(S) : Ng et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1284 days.

Signed and Sealed this

Thirtieth Day of November, 2010

David J. Kappos

David J. Kappos
*Director of the United States Patent and Trademark Office*